US009732561B2

(12) United States Patent
Carter, Jr.

(10) Patent No.: US 9,732,561 B2
(45) Date of Patent: Aug. 15, 2017

(54) METHOD AND APPARATUS FOR INCREASING WELL PRODUCTIVITY

(71) Applicant: Ernest E. Carter, Jr., Sugar Land, TX (US)

(72) Inventor: Ernest E. Carter, Jr., Sugar Land, TX (US)

(73) Assignee: Ernest E. Carter, Jr., Sugar Land, TX (US)

( * ) Notice: Subject to any disclaimer, the term of this patent is extended or adjusted under 35 U.S.C. 154(b) by 0 days.

(21) Appl. No.: 15/198,995

(22) Filed: Jun. 30, 2016

(65) Prior Publication Data

US 2017/0074043 A1 Mar. 16, 2017

Related U.S. Application Data

(63) Continuation of application No. 13/130,579, filed as application No. PCT/US2009/067431 on Dec. 10, 2009, now abandoned.

(Continued)

(51) Int. Cl.
*E21B 7/28* (2006.01)
*E21B 43/263* (2006.01)

(Continued)

(52) U.S. Cl.
CPC ..... *E21B 7/28* (2013.01); *E21B 7/04* (2013.01); *E21B 11/00* (2013.01); *E21B 11/06* (2013.01);

(Continued)

(58) Field of Classification Search
CPC ..... E21B 7/28; E21B 43/263; E21B 11/00; E21B 7/04; E21B 11/06; E21B 43/26; E21B 43/305; E21B 43/04
See application file for complete search history.

(56) References Cited

U.S. PATENT DOCUMENTS

| | | | |
|---|---|---|---|
| 733,073 | A | 7/1903 | Neukirch |
| 753,092 | A | 2/1904 | Neukirch |
| 2,796,129 | A | 6/1957 | Brandon |
| 2,904,313 | A | 9/1959 | Wisenbaker |
| 3,286,452 | A | 11/1966 | Gathman |
| 3,420,323 | A | 1/1969 | Owens |
| 3,602,300 | A | 8/1971 | Jaffe |

(Continued)

FOREIGN PATENT DOCUMENTS

| | | |
|---|---|---|
| RU | 2154733 C1 | 8/2000 |
| RU | 2178073 C1 | 1/2002 |

OTHER PUBLICATIONS

PCT Application No. US2009/067431; International Search Report of the International Searching Authority for Applicant Ernest E. Carter, Jr. dated Apr. 5, 2010.

*Primary Examiner* — Michael Wills, III
(74) *Attorney, Agent, or Firm* — Jones Walker LLP

(57) ABSTRACT

This patent application discloses method and apparatus to cut an extended slot connecting a well to a substantial cross section of a desired producing formation whereby material can flow freely between the formation and the wellbore and at least partially overcome the flow limitations of low permeability formations without the environmental issues associated with hydraulic fracturing. It is further disclosed that the connection between said slot and the formation may be further enhanced by explosive or combustive processes that rapidly generate gas pressure within the large surface area of the slot, thereby changing its characteristics and forcing open additional fractures into the cross section of formation exposed to the slot. The method may significantly increase the recoverable percentage or natural gas from low permeability deposits such as shale and coal.

24 Claims, 23 Drawing Sheets

Related U.S. Application Data

(60) Provisional application No. 61/217,941, filed on Jun. 5, 2009, provisional application No. 61/201,400, filed on Dec. 10, 2008.

(51) Int. Cl.

| | |
|---|---|
| ***E21B 11/00*** | (2006.01) |
| ***E21B 11/06*** | (2006.01) |
| ***E21B 43/26*** | (2006.01) |
| ***E21B 43/30*** | (2006.01) |
| ***E21B 7/04*** | (2006.01) |
| *E21B 43/04* | (2006.01) |

(52) U.S. Cl.

CPC ..... *E21B 43/26* (2013.01); *E21B 43/263* (2013.01); *E21B 43/305* (2013.01); *E21B 43/04* (2013.01)

(56) References Cited

U.S. PATENT DOCUMENTS

| | | | |
|---|---|---|---|
| 3,958,641 | A | 5/1976 | Dill et al. |
| 4,049,056 | A | 9/1977 | Godfrey |
| 4,330,043 | A | 5/1982 | Sheffield et al. |
| 4,346,761 | A | 8/1982 | Skinner et al. |
| 4,442,896 | A | 4/1984 | Reale et al. |
| 4,854,399 | A | 8/1989 | Zijsling |
| 4,943,189 | A | 7/1990 | Verstraeten |
| 5,346,015 | A | 9/1994 | Grundmann |
| 5,515,679 | A | 5/1996 | Shulman |
| 7,128,156 | B2 | 10/2006 | McClung, III |
| 7,308,940 | B2 | 12/2007 | Vuyk et al. |
| 8,387,688 | B2 | 3/2013 | Carter, Jr. |
| 8,739,874 | B2 | 6/2014 | Ocampos et al. |
| 2003/0205174 | A1 | 11/2003 | Carter, Jr. |
| 2005/0155766 | A1 | 7/2005 | Vuyk et al. |
| 2007/0158072 | A1 | 7/2007 | Coleman et al. |

Section I-I

Alternate Section I-I

Fig 6
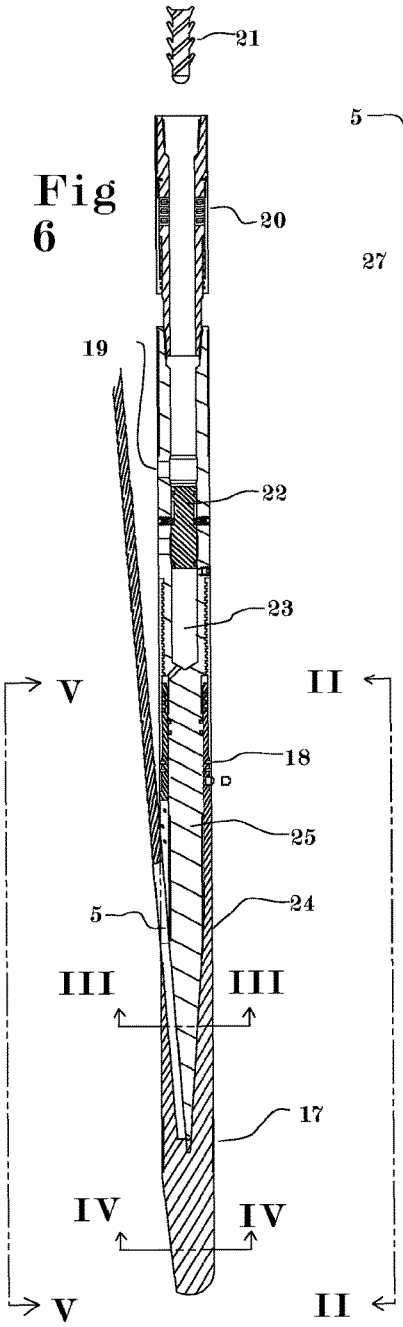
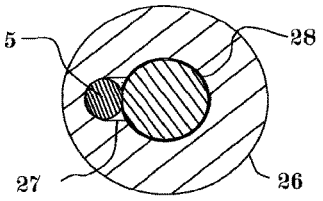
Section III-III
Fig 8
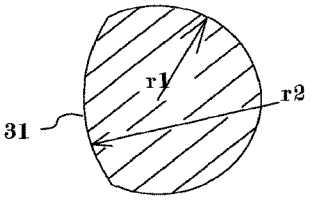
Section IV-IV
Fig 10
Fig 7
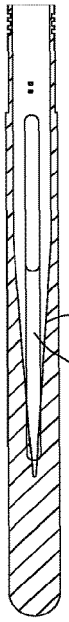
Center Line Section II
Fig 9
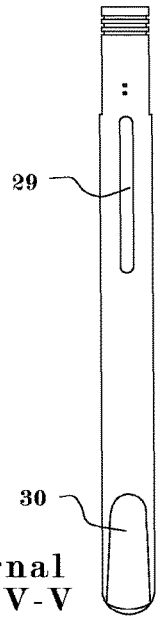
External view V-V

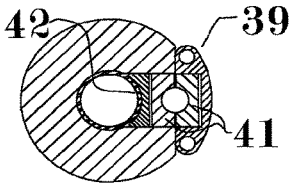
Fig 15
Fig 16
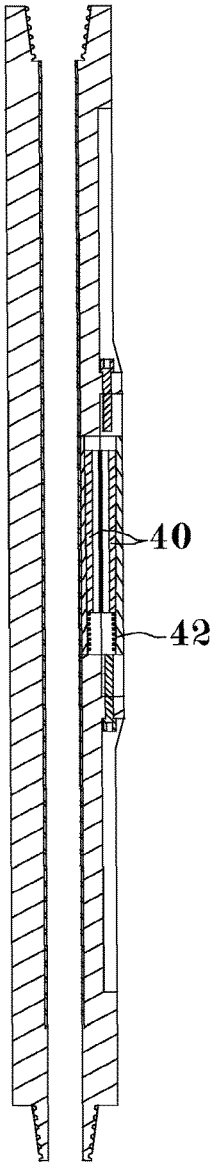
Fig 17
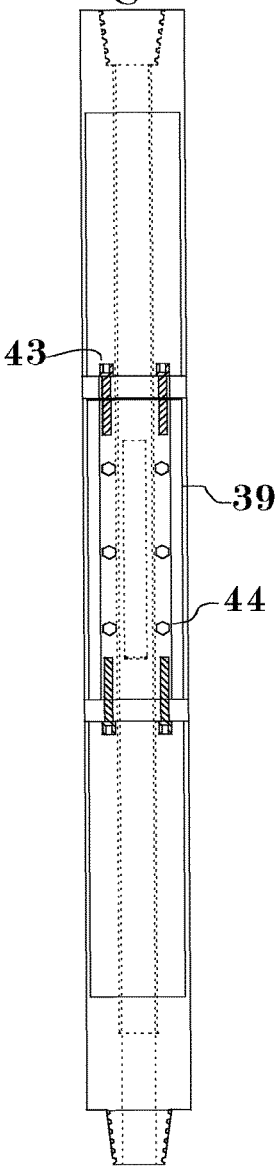
Fig 18
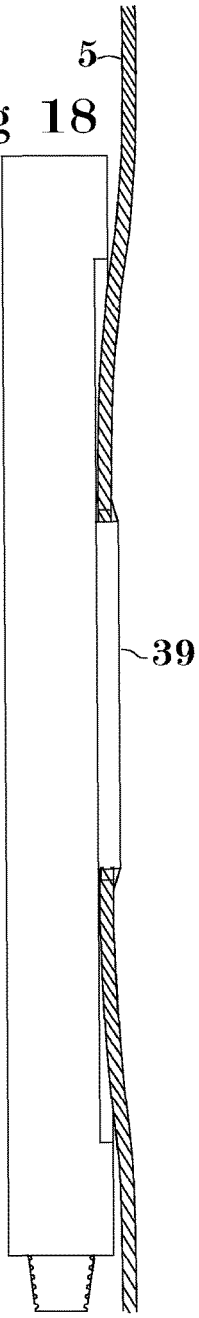

Section VI-VI

Fig 36
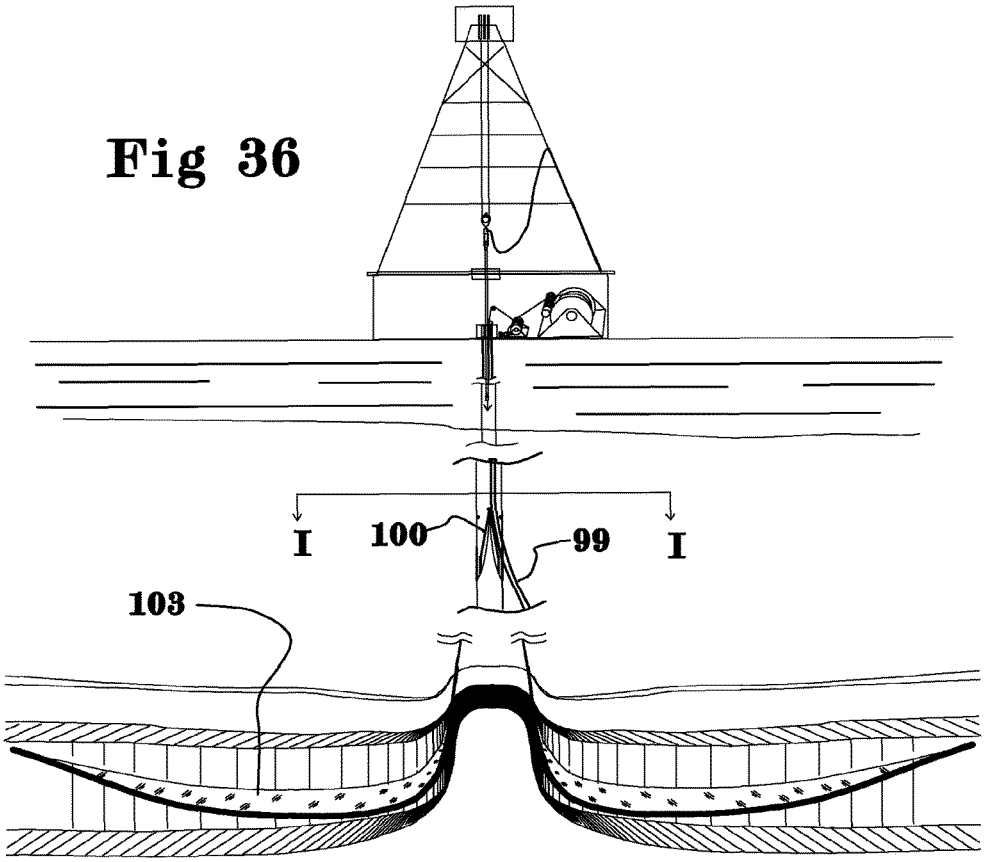
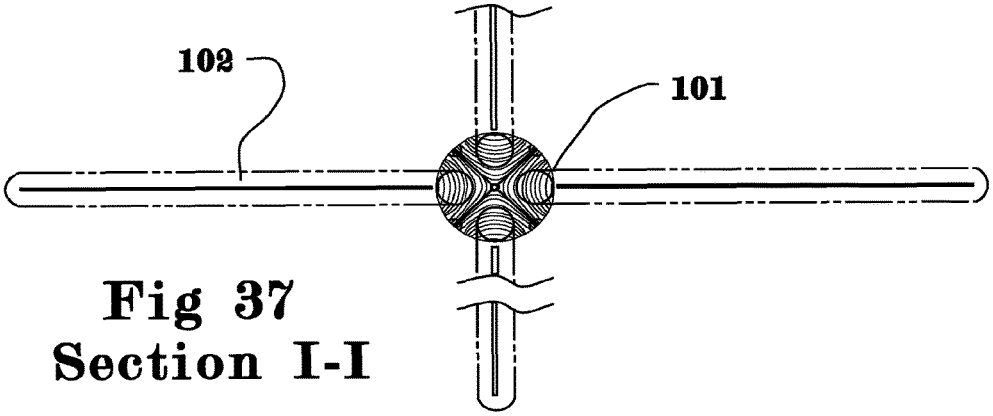
Fig 37
Section I-I

Section I-I

Fig 43
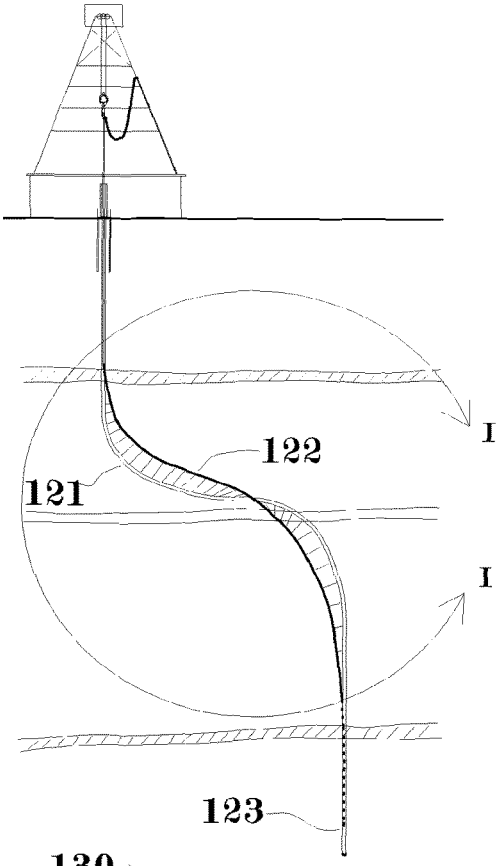
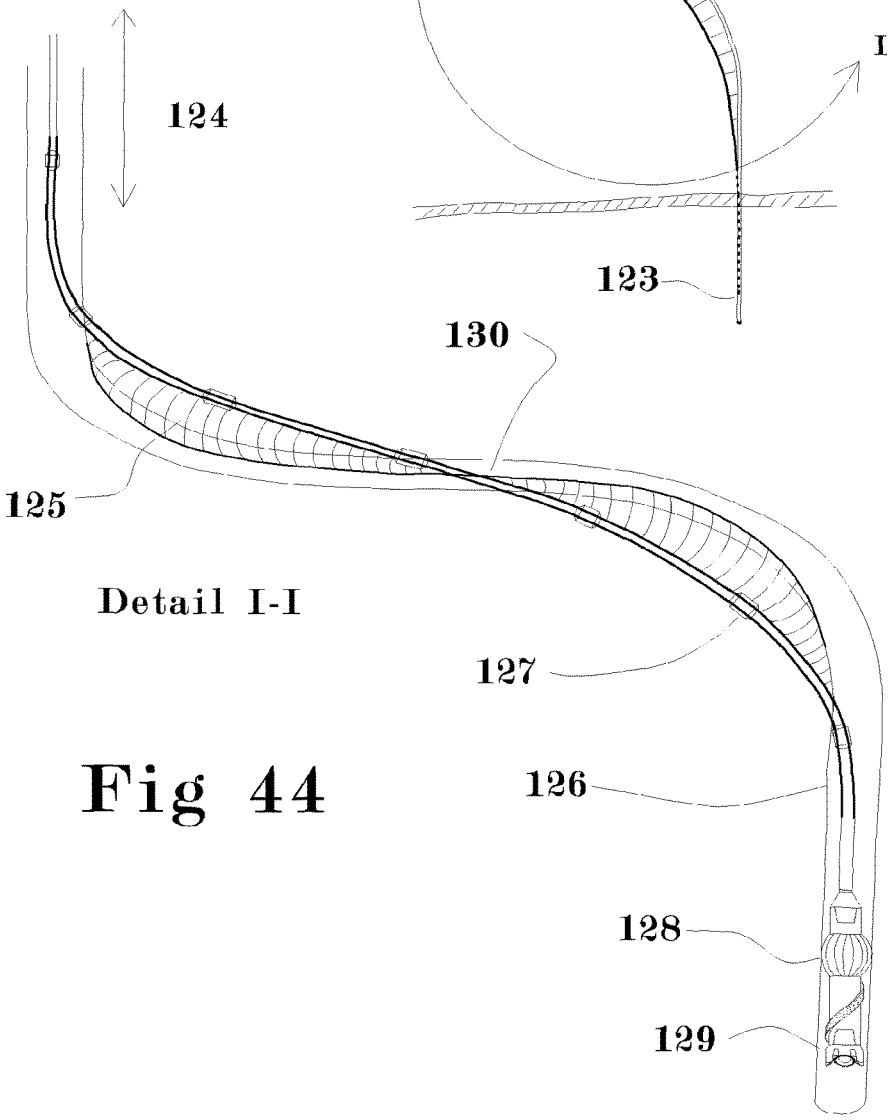
Fig 44

METHOD AND APPARATUS FOR INCREASING WELL PRODUCTIVITY

CROSS-REFERENCE TO RELATED APPLICATIONS

This application is a continuation of U.S. application Ser. No. 13/130,579, filed on May 23, 2011, which is a 371 of PCT/US2009/067431, filed on Dec. 10, 2009, which claimed the priority benefit of U.S. Provisional Application 61/201,400 filed Dec. 10, 2008 and U.S. Provisional Application 61/217,941, filed Jun. 5, 2009, all of which are incorporated by reference herein.

FEDERALLY SPONSORED RESEARCH

At least a portion of this invention was made under a government contract DE-AC26-07NT42677 subcontract 07122-07 awarded to Carter Technologies Co, a Texas Corporation and small business wholly owned by the inventor Ernest E. Carter, Jr. Carter has applied for and received notice of patent waver under P.L.96-517 (FAR 52.227-12 Patent rights—Waiver (July 1996), as modified by 10 CFR 784, DOE Patent Waiver Regulations) and Carter has elected title to this invention and all patent applications arising from the work.

BACKGROUND—FIELD OF INVENTION

A well is typically drilled in order to extract resources from the earth or as a zone to dispose of unwanted materials. The resources may include oil and gas, minerals, or even geothermal heat and things to be disposed may include waste heat, contaminated water, or even carbon dioxide. In many cases the effective production of resources from a well is limited by the permeability of the subterranean formation strata and the total surface area of the well bore and nearby fractures.

The value of oil and gas wells varies greatly according to the rate at which the well produces. Some formations such as shale rock have been found to contain large volumes of natural gas but the permeability of the rock is so low that wells drilled into the shale rock produce only small flows of gas which are insufficient to pay for the expense of the well. To obtain greater recovery of gas, wells are often drilled so that they turn horizontally and run for some distance within a thin shale layer to increase the area of well bore within the layer.

The surface area of the well can be further increased by injecting water into specific areas at high pressure to crack the rock in a process known as hydraulic fracturing. Hydraulic fracturing is the most common technique for increasing the productive surface area of a well. Hydraulic fracturing is not always as effective as desired due to the difficulty of controlling the orientation, thickness, and magnitude of the fractures. Injecting very large volumes of chemically treated water is also an environmental concern as it can potentially pollute fresh water or cause earth tremors. Fractures may also breech and damage natural impermeable barriers underground allowing water to intrude into new areas. In the case of a shale gas well, intruding water can interrupt the production of gas.

OPENING SUMMARY

The present patent application describes a method and apparatus for increasing well productivity without hydro-fracturing. The method describes a method and apparatus for manipulating an abrasive cutting member within a well to cut an extended slot. This extended slot connects the well to a substantial cross sectional area of a desired producing formation whereby the rate of flow of resources between the formation and the well is substantially increased. The effective increase in surface area may provide results comparable to hydraulic fracturing while avoiding the environmental issues associated with that technology. The method and apparatus described herein provide means of enhancing a well by mechanical cutting of a very extensive planar groove, herein referred to as a slot, cut, gallery, or panel, along a well bore and extending away from the well bore axis and cutting across a very large cross section of the formation.

In this patent application a "slot" generally comprises a deep longitudinal groove extending away from a bore hole for a distance of at least several feet but potentially hundreds of feet. The slot is nominally a planar cut beginning along an extended length of the well bore and extending a substantial distance away from the wellbore through the subterranean rock formation. The slot effectively increases the available surface area of the well bore to enhance the flow connection between the formation and the well bore.

The slot may be thinner than the diameter of the well bore but is much thicker and more uniform than a man-made hydraulic fracture and preferably may extend a hundred feet or more into the formation all along a substantial length of the well bore connecting it to a substantial cross sectional area of the desired producing formation. The "desired producing formation" may contain oil, natural gas, soluble mineral resources, geothermal heat, Kerogen (oil shale) or any resource. The slot acts as a gathering gallery that contacts a very large surface area potentially crossing many existing fractures in the formation. Many of these natural fractures also expose a large surface area of the formation. This increases the potential flow rate between the formation and the well bore much like freeways increase the mobility of cars within a city. The slot can also facilitate flow of material from the well into the formation. This could be used to inject carbon dioxide into a formation at lower pressure so that it remains in a well-defined area. In this case the resource is a disposal zone. The slot can also be used as a down hole heat exchanger to harvest geothermal heat.

The slot may be cut by any suitable process that can cut an extended opening deep into the formation from an initial drilled borehole. In this patent application, the inventor teaches that a slot may be created to improve productivity of a well intended to extract hydrocarbon, geothermal, or chemical resources from the earth or to inject materials into the earth for environmental remediation. Additionally the method includes means for further improving the connection between a slot and a formation by causing a rapid increase in gaseous pressure within the slot to open cracks in the rock formation.

Generating the force to cut a slot from the well bore deep into the formation is a previously unsolved problem which is solved by the method herein with various types of apparatus disclosed herein. It is desirable to cut a slot which is deep enough and long enough to increase the effective surface area of the wellbore by at least a factor of 10 and perhaps a factor of 1000 or more. This magnitude of improvement requires of slot along a substantial length of the well bore of hundreds or thousands of feet that is preferably cut to depths of tens to hundreds of feet. The slot must be of sufficient width or conductivity that it does not restrict the flow of the resource being sought.

DISCUSSION OF PRIOR ART

In prior art, U.S. Pat. No. 4,346,761 jets of high pressure water have been used to cut through well casing as well as cutting into the formation. However the jet energy is reduced by ambient hydrostatic pressure and also diminishes rapidly away from the jet orifice, especially in a liquid environment, effectively limiting the depth of a slot to less than a meter. Jet nozzles on the end of a flexible hose have been shown to be capable of carving out cavities around a well bore as in U.S. Pat. No. 3,958,641 but are unsuitable for cutting deep slots because they cut randomly in all directions and not just in a planar path.

Explosive shaped charges are used to cut perforations into the well bore to expose more surface area; however these are usually less than a meter deep and are typically a series of small holes and not a continuous slot. Under-reaming tools have mechanisms that expand down hole and enlarge the well bore itself but are limited to doubling or tripling the bore diameter. Mechanical tools that drag along the bore hole or have rotating end mill style cutters can cut a shallow groove but generally cannot form cuts deeper than the diameter of the well bore and none in prior art can cut a slot deeper than twice the diameter of the wellbore. In conventional drilling, the force to drill through rock comes largely from the tremendous weight of the pipe on the drill bit combined with rotation of the drill bit. Generating the required mechanical force to cut rock deep in a slot away from a relatively small borehole becomes increasingly difficult as the cut deepens.

In prior art, U.S. Pat. No. 4,442,896 it has been disclosed that a "U" shaped bore hole looping down into the ground and back to the surface could have a wire rope cable extending through it and back to the surface with pulling means on each end to reciprocate the cable and cut upward from the "U" shaped borehole in a coal bed. Tension on the cable from both surface locations produces an upward cutting force. This approach would form a cut that is very tall vertically compared to its horizontal length and may be less desirable to access a thin gas production formation.

It is uncertain if this upward cutting from a "U" shaped bore hole has ever been accomplished from a vertical borehole. Drilling a "U" shaped hole down and back to the surface is difficult and making two independently drilled holes connect to form a "U" is also difficult. Reciprocating the cable would require two surface equipment rig locations and coordination between them or a pulley system back to the first rig. Another problem is that for holes that traverse nearly 180 degrees of arc, the friction may be so great that the cable becomes stuck. Placing pulley sheaves down hole on the ends of pipes can reduce friction but the required pulley diameter is generally too large to place in the common size of hole.

More recently USPTO Patent Application 20070158072 describes a similar process wherein two bore holes are drilled from the surface and then turned laterally to intersect. Then a flexible linear cutting device such as a diamond wire saw is circulated from the surface and fished through the intersection and back to the surface. It is claimed to cut a planar fissure that begins at the intersection and extends some distance along the wellbores. This method is also thought to have feasibility issues related to friction of the wire saw around too great of a total arc of contact, nearly 180 degrees at the intersection plus the total arc of curvature of both wells. Since friction increases exponentially with the contact angle the cable would be likely to be stuck by friction alone.

Chainsaw mechanisms and circulation cable saws circulate a continuous chain or wire rope abrasive cable as a cutting element and are commonly used as hand tools for cutting objects. These solve the friction problem by having the chain or cable run on a wheel or low friction pulley so that the cutting member contacts the surface to be cut only along a smaller arc of contact. These have been considered for cutting a slot in a wellbore but they are limited by the minimum diameter of the wheel supporting and driving the cutting elements of the cable or chain. An abrasive cable cutting a 1 inch wide slot might require a pulley wheel 2 feet in diameter and so the hole would have to be that large as well. The ratio of the bore diameter to the width and depth of the cut that is mechanically feasible is believed insufficient for increasing the productivity of wells. Delivering a sufficient amount of energy to the device to cut at a reasonable rate is also problematic. This type of mechanism cutting more than two or three times the borehole diameter into the wall of the hole for a substantial length is probably not possible.

During drilling of wells the reduced diameter body of a drill pipe can become pressed against the wall of the hole at a bend or angle change and if the wall of the hole is soft the moving pipe may accidently cut a slot into the wall. This slot is known as a keyseat and is highly undesirable since the larger diameter drill pipe joints and drill bit cannot be pulled back up through this keyseat. Keyseat wipers are used in the drill pipe so that these keyseats can be regularly reamed out so that the drill pipe does not get stuck. U.S. Pat. No. 2,904,313, U.S. Pat. No. 3,420,323 and U.S. Pat. No. 4,330,043 are examples of such keyseat wipers.

Keyseats occur only at the point where there is a sharp bend in the line of the borehole. The resulting keyseat will have a substantially triangular or crescent profile shape. While many efforts have been made to prevent the cutting of a keyseat or to recover from one, no prior art has contemplated the potential benefit of intentionally cutting a keyseat. In the present method, some of the basic physical principles that cause the keyseat problem while drilling a well can be utilized to provide the force against the side of the hole to cut an extended longitudinal slot of relatively uniform depth and increase the total productive surface area of the wellbore significantly as shown in FIG. 43 and FIG. 44.

Keyseats slightly increase the total surface area of a wellbore but generally since they occur only at sudden bends in the borehole any such increase would not be significant even if they cut deeply into the bend. Such accidental surface area increase would certainly not amount to even double the original surface area of a wellbore through the entire production zone. The present method intentionally makes substantially uniform slots along a substantial length of a wellbore to increase the total surface area of the wellbore within the producing formation. This would typically increase surface area by at least a factor of three.

In the present method the shape profile curvature of the hole may be designed to allow a suitable abrasive element means to bear against the wall of a borehole with a substantially uniform force as it moves along an extended curved length of the borehole. Thus instead of forming a slot only at a local bend point in the borehole, an extended slot is formed along a substantial length of the borehole.

Prior art also includes the use of explosives and propellants in boreholes to fracture a formation. Russian Patents numbers 2154733 and 2178073 describe pumping a fuel and oxidizer solution into a well and igniting it to generate multiple fractures from the wellbore. U.S. Pat. No. 5,346,015 describes injection of gaseous fuel such as propane and a gaseous oxidizer into a well and igniting it to produce a rubble zone to enhance production. Generally explosions have been found to produce local rubble and dust rather than deep penetrating fractures.

DEFINITIONS AND SYNONYMS

The method and apparatus described herein is sufficiently unlike prior art that there is no agreed standard terminology for describing all components and there are many possible synonyms. The terms borehole, wellbore, well bore, hole, well, and open hole may be used interchangeably to refer to the hole that is drilled down into the earth to extract resources. The earth that the hole passes through may be called the formation rock strata, the formation, the rock, hot rock, the shale, the earth, the "face of the cut", or simply the sidewall of the hole.

The "slot" refers to the cavity perpendicular to the wellbore that is formed by the method and apparatus. It may also be referred to as "the cut", groove, crevasse, planar slot, panel, gallery, or pathway. The slot may be in any orientation even if nominally referred to as "the vertical cut". A slot is a longitudinal groove along at least a portion of a wellbore wherein groove is at least deeper than 2 well bore diameters away from the wall of the wellbore. In this patent application a slot is not just a few inches or even a few feet deep but is intended to be tens or hundreds of feet deep all along a length of thousands of feet along the wellbore. The wellbore is directionally drilled with a profile and curvature that maximizes the cross section of the producing formation cut by the slot. A slot is preferably oriented such that it cuts through a desired producing formation in the way most likely to cross existing fractures and exposes a substantial cross section of the producing formation to the well bore. By "substantial cross section" we mean at least over 10,000 square feet and preferably on the order of 100,000 square feet. Slots of less than this magnitude would not achieve the aim of increasing productivity of a well.

Aspects of the invention deal with pipe in a directionally drilled wellbore which can curve through a substantial arc of curvature so and even curve back toward the surface at its distal end. The terms "down" and "up", "below" and "above", "upper" and "lower", "bottom" and "top", when applied to the wellbore or tools in the wellbore or the slot are to be understood as a reference to direction along the path of the wellbore and not as references to absolute elevation or true vertical depth. Likewise the term reciprocation is to be understood as moving up and down when referring to the drill pipe in a vertical drill rig and back and forth along the stroke of a slant hole or horizontal drilling rig and also along a curved or directionally drilled well bore or a slot.

The term "drilling fluid" may refer to any fluid circulated in the hole including drilling mud, air, steam, water, foam, water with additives, salt water, calcium chloride water, potassium chloride water, polymers, bentonite dispersed in water, or oil based mud made from hydrocarbons and various types of clay.

The term "pipe" comprises most any type of oil well tubular good including drill pipe, oil well tubing, casing, drill collars, and coil tubing. The pipe may be referred to as "the drill pipe", or "the string". The pipe can also be a cutting element or a tensile element and be referred to in general terms as an abrasive cutting member. Pipe may be made of steel or from carbon fiber or fiber glass fiber composite material. The "pipe" may be the same drill pipe, casing or tubing used to drill the well or it may be a different one with special characteristics, such as a sand screen or external flush threaded connections.

Steel wire rope is a rope made from steel wires which may optionally have a core made of other material. Wire rope may also be referred to as cable, wire rope cable, steel wire rope cable, diamond wire, diamond abrasive cable, wire saw, cutting cable, cable saw, or wire rope saw. It may also be described in general terms as: abrasive tensile member, connected tensioned abrasive member, or abrasive cutting member. In this patent application it may also mean wire rope that has been coated or infused with rubber or plastic material, or which has abrasive materials or abrasive beads added to it as in commercial diamond wire saw material. The abrasive material may be impregnated in sleeves, called beads, which fit over the wire rope and are separated by coil springs.

When a cable is used to cut the slot it is attached to a shoe tool which could also be called a nose tool to secure it to the bottom of the drill pipe.

The apparatus comprising a pipe and a connected tensioned abrasive cutting member may also be called a Slot Drill, wire rope saw or a Slot Drilling String.

In creating pulses of gas pressure to open fractures from a slot the terms combustion, combustive, explosion, explosive, deflagration, rapid burning and similar terms related to chemical reactions that rapidly release gas are used as interchangeable terms. Thus a claim of using combustion of a mixture of natural gas to increase pressure and cause fractures in a slot also applies if the pressure wave or shock wave of the reaction is technically an explosion. Likewise an explosive substance placed in the slot is intended to create a very fast spike of pressure against the planar surface and not to break it into small chunks so it could be considered a deflagration.

DESCRIPTION OF THE DRAWINGS

In FIG. 6, a shoe 17, or shoe piece is shown that combines a releasable cable attachment means 18, with a circulating port 19, and a low friction swivel 20. A cementing plug 21, is pumped down the pipe and lands on piston 22 temporarily closing the circulating port and moving piston to shear pins and extrude grease from cavity 23 causing shell piece 24 to separate from conical mandrel 25 and release end of cable 5.

FIG. 7, longitudinal section view II, shows the box end conical sleeve 26, with the groove 27, for the cable and the external hole for the cable to reach the groove.

FIG. 8 radial cross section III-III shows the cable 5, being clamped between the conical sleeve 26, and the conical mandrel 28.

FIG. 9 section V-V shows the exterior of the conical sleeve with the hole for the cable 29, and the flat 30.

FIG. 10 section Iv-Iv shows the radial cross section of the shoe or shoe piece with the milled flat ground to the radius of the hole 31.

FIG. 15 shows a radial section view of the cable grip tool. The hinged cover 39, clamps over two die halves 40, that clamp the cable, by means of pressure applied from a rubber sleeve 41, on the inside diameter of the tool.

FIG. 16 shows a cross section of the cable grip mechanism. The two die halve 40 rest in a tapering cavity that brings them closer together around the cable when they are pulled down against the spring 42, by the release of cable tension from the winch on the surface while the pipe interior is pressurized by circulating fluid under pressure.

FIG. 17 shows the exterior view of the top of the hinged cover 39 with 4 hinge bolts 43, and six additional bolts 44, to secure it.

FIG. 18 shows a side exterior view of the grab tool with the cable 5, threaded through the hinged cover 39.

Figure 1:
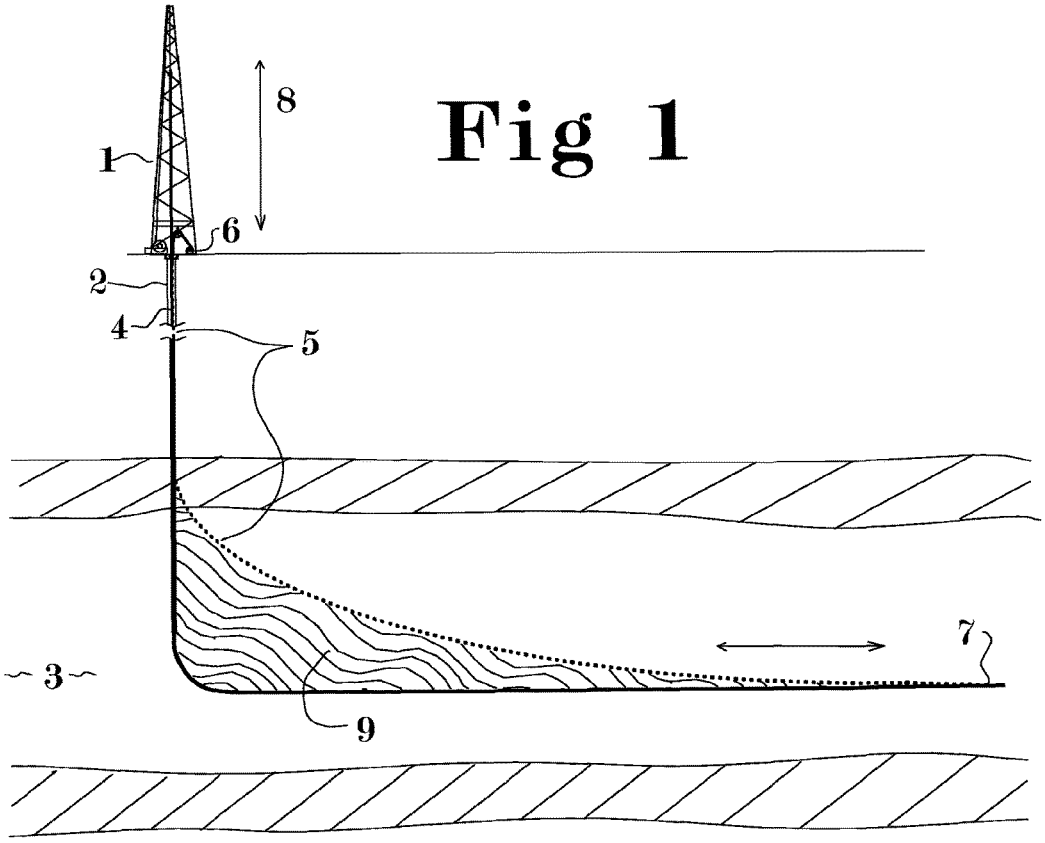
FIG. 1 shows a drilling rig 1, with a borehole 2, extending down to a subterranean gas producing formation layer 3, and extending horizontally through said formation for a significant distance. A pipe 4, in the well bore extends to the end of the wellbore. A wire rope cable 5, is attached at the surface to an automatic tensioning winch 6, and the other end is attached to the bottom end of the pipe 7. The pipe is reciprocated through the available stroke 8, of the rig. As the pipe is reciprocated the wire rope cable also reciprocates and makes a planar cut 9, through the formation.

At the level of the rig floor 90, the rotary table slips hold the pipe when new pipe sections are added. The traveling block 95 raises and lowers the drill pipe 96 and the action of the cable 97 cuts a slot shown at 98 in cross section view I-I which collects hydrocarbon or thermal resources from the formation.

FIG. 36 shows a view of similar rig with the drill pipe 99 passing through a special whipstock tool 100 at the bottom of the cemented casing. The whipstock tool allows the drill pipe to kick off in one of 4 directions from a larger diameter vertical cased hole.

FIG. 37 is the section view of the whipstock with 4 laterals coming off the primary vertical well 101. Each lateral has a slot 102 extending upward as shown in FIG. 36 item 103.

Figure 38:
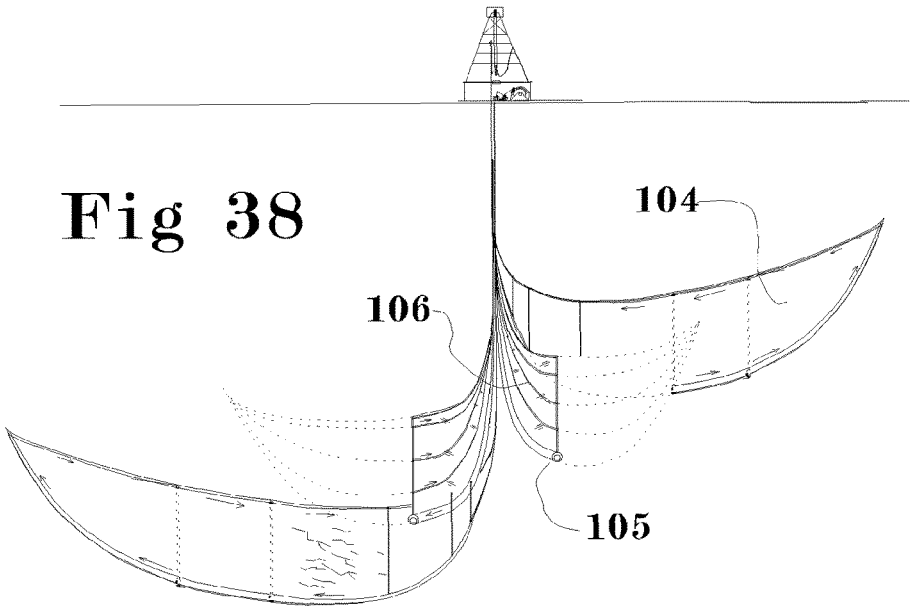

FIG. 38 shows multiple slots coming off one vertical well bore in different directions from slightly different depths. Each of the slots 104 has primary piping 105 in the original drilled hole 105 and one or more coil tubings 103 at different levels in the slot.

Figure 39:
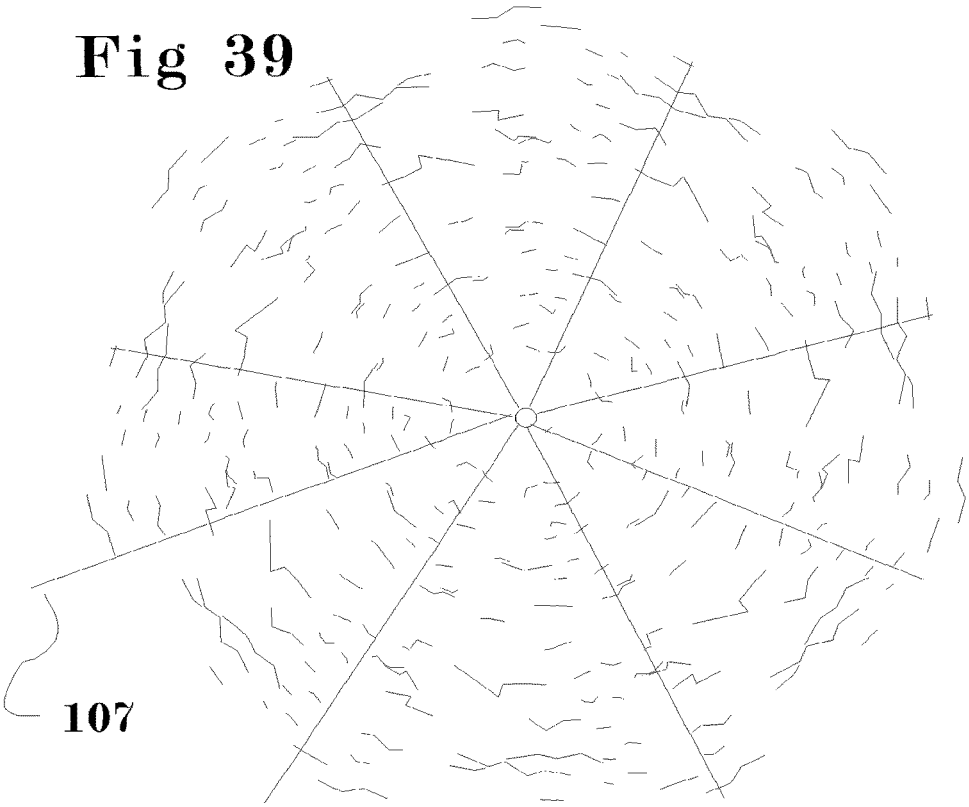

FIG. 39 shows a plan view with 8 laterals 107 coming off a central well bore with fractures in the rock between the laterals.

Figure 40:
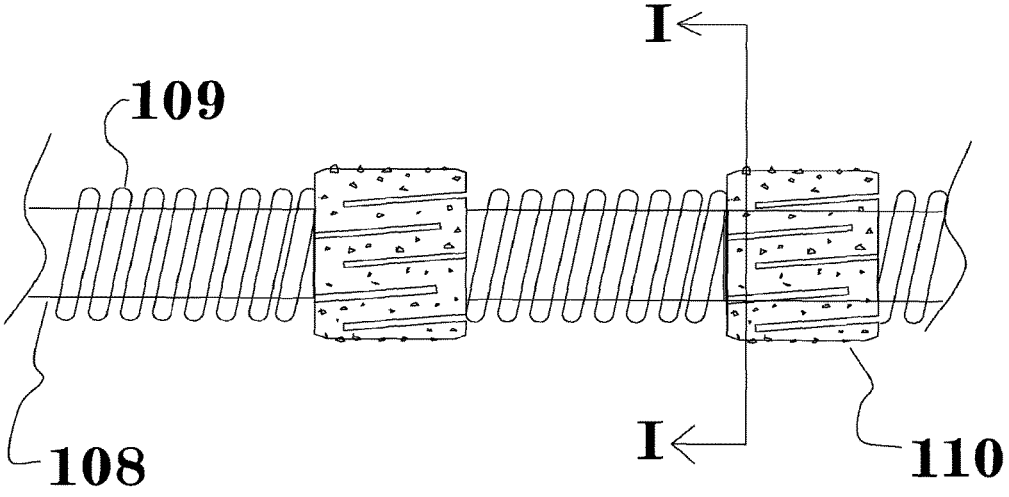
Figure 41:
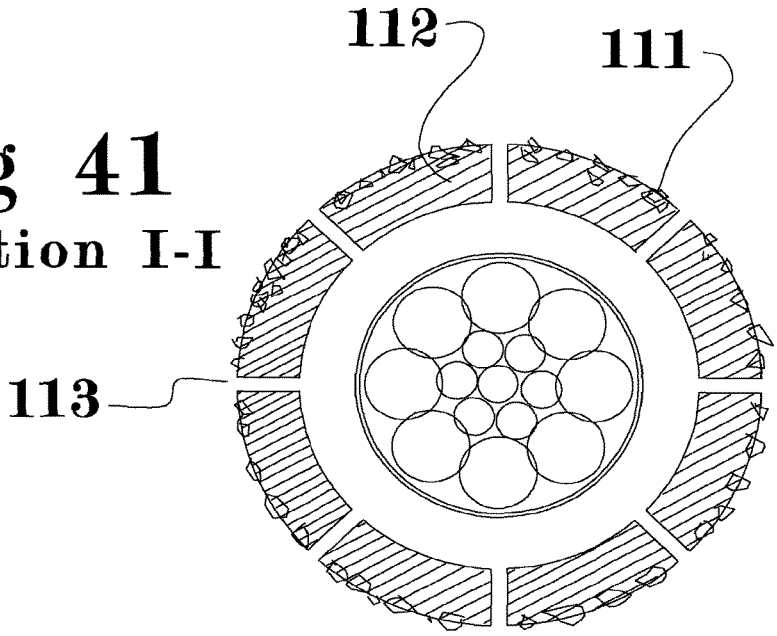

FIGS. 40 and 41 show a diamond abrasive cable comprising a steel wire rope 108, and coil springs 109 with a steel sleeve 110 having diamonds 111 embedded into its surface. The sleeve is has a series of angled cuts 113 that allow each radial segment 112 to compress to compress to pass through a smaller diameter.

Figure 42:
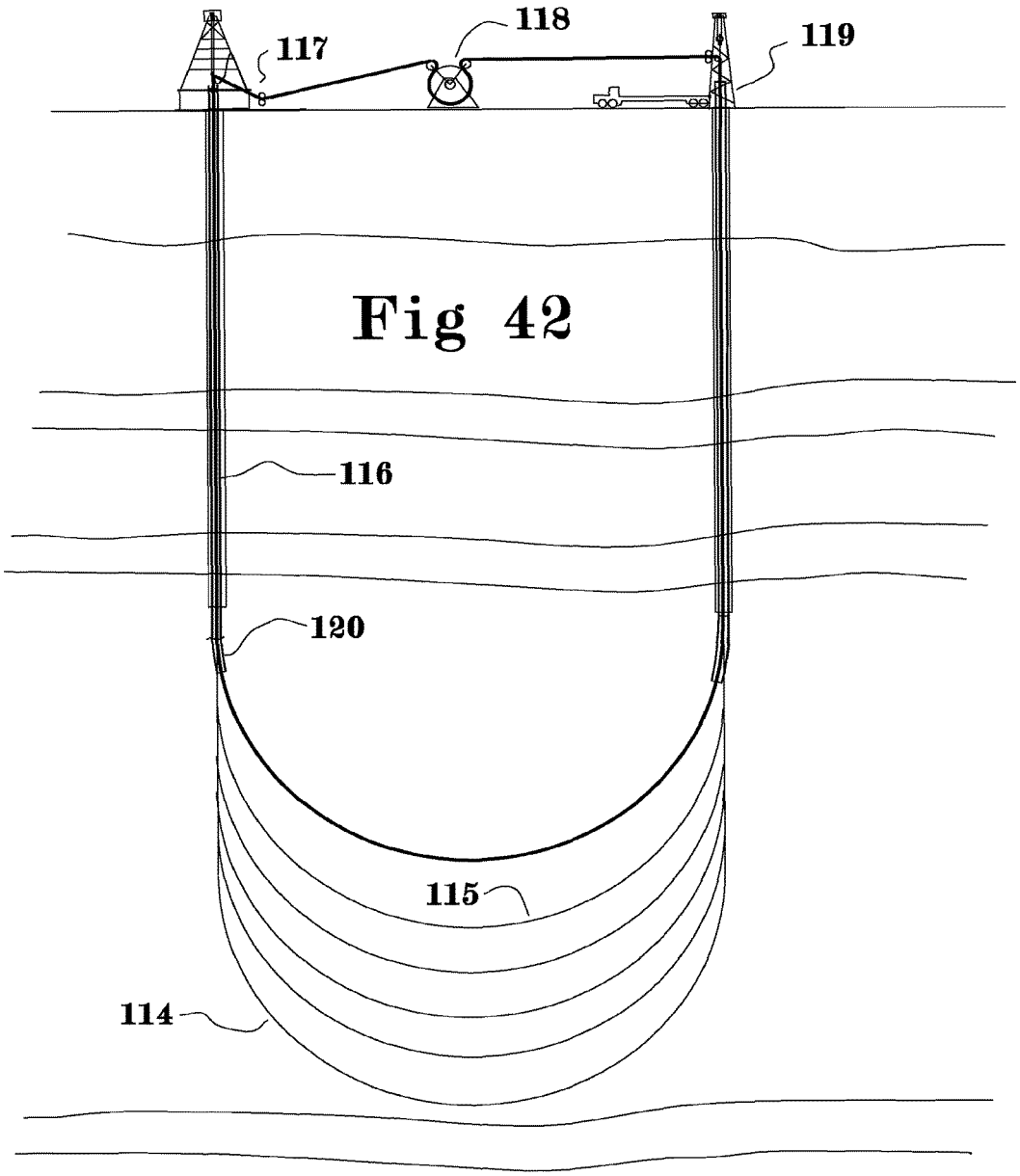

FIG. 42 shows a U shaped 180 degree turn borehole 114 with piping loops 115 installed to circulate fluid through a vertical slot at depth. A portable rig 119 is positioned over the point where the drill pipe breaks out to the surface. The vertical pipes to the surface are insulated with one pipe 116 inside the other and a vacuum between them. The abrasive cable saw is supported at the surface by pulley sheaves 117 that convey it to a large traction drive wheel 118 that supplies power to circulate the cable through the cut. The traction drive is nominally somewhere in between the two rigs and mounted to a track that slowly moves it along a path perpendicular to a line between the two rigs to maintain cable tension. Alternately each rig could have its own cable reel and traction drive to reciprocate the cable back and forth. When cutting the slot the cable may be moved continuously through the slot by the mechanism at the surface or it may be reciprocated by gripping the cable to smaller tubing pipes 120 which are mechanically reciprocated up and down by the rig.

In FIG. 43 a hole is directionally drilled to form an S-bend that terminates in a substantially downward direction so that the weight of the drill bit and drill pipe 129 add tensile loading to the drill pipe along its length. In FIG. 44 a drill pipe with abrasive cutting surfaces all along its exterior or at located at suitable intervals 127 is placed in the hole 126 and rotated and reciprocated through stroke 124 in the same manner as in FIG. 29. The abrasive drill pipe cuts into the side of the hole 126 as it seeks a shorter path.

If the hole is in one plane then there is little cutting at the inflection point 130 but if the lower half of the S-bend is at an angle to the top bend then the abrasive action forms a curved ribbon shape slot 125 that extends away from the inflection point 130. A drag tool 128 on the lower part of the drill pipe can be actuated or inflated to increase the drag and thus the tensile load on the drill pipe so that the cutting force is increased.

DETAILED DESCRIPTION OF FIRST EMBODIMENT OF THE METHOD

The force to cut a slot arises from tensioning an abrasive cutting member along a curved borehole to create force perpendicular to the axis of the abrasive cutting member and borehole. This force causes the abrasive cutting member to bear against the inside radius of the bore hole and cut into the rock as the abrasive cutting member is held in tension and moved along the curving bore hole. Various apparatus may be utilized in conjunction with the pipe movement capabilities of a conventional oil and gas type drilling rig to produce the required tension and movement in the abrasive member. The formation cuttings produced by the action of the abrasive member may be removed from the slot by circulating liquid or foam drilling fluid, gas, or compressed air through the bore hole and the slot.

In this implementation of the method, the abrasive member is a tensioned abrasive cable driven by reciprocation of the drill pipe to perform the cutting. A suitable winch system automatically maintains optimal tension in the cable during reciprocation and also as the drill pipe is lowered to prevent the pipe from twisting and wrapping the cable around the pipe. The slot may be cut from a directionally drilled blind hole from a single rig location using the cable friction and curvature of the hole to produce the lateral cutting force. The energy to cut the rock is all supplied by up and down motion of the drill pipe. Substantially all the cutting action may confined to the open hole below a cased vertical interval by selecting appropriate cable tension and hole curvature parameters.

The apparatus in the first implementation operates somewhat like a down hole hacksaw. The abrasive cutting member is a steel wire rope cable held in tension by a mechanical frame, comprising the drill pipe, which is reciprocated up and down by a drilling rig at the earth's surface such that the cable is also reciprocated along and bears against the inside radius of the of the curved portions of the hole. The portion of the hole where the slot is to be cut is curved rather than straight so that the tensioned cable bears against the inside radius of the curve resulting in abrasive cutting of a slot by the cable.

A winch means or reel of cable on the drilling rig is equipped with suitable controls to hold a desired constant tension on the cable above ground surface. Optionally the cable tensioning mechanism may be attached to the pipe or the traveling block so that it does not have to take in and pay out cable as the pipe moves up and down. The cable tension may also be created by a suitable down hole tool somewhere along the drill pipe. The method of tensioning the cable may be done by any suitable manner such as a down hole tool that tensions the cable without the need to extend the cable back to the surface. This may cost more initially but offers the advantage of not dealing with the cable at the rig floor. The lower end of the cable is connected to the lower end of the drill pipe and the drill pipe is lowered into the hole. The pull of the pipe dropping into the hole pulls down on the cable but the constant tension winch at the surface pays out cable to compensate and maintain a constant cable tension at the surface.

The weight of the cable in the vertical hole decreases local cable tension with depth but the tension at the surface is adjusted to maintain some desired minimum cable tension at the point where the hole begins to curve. Friction of the cable against the inside radius of the hole increases the tension in the cable along the length of the curved hole. Lateral force is generated by the cable tension around the curve of the hole and this force presses the abrasive cable cutting elements into the rock face as the cable is reciprocated. The force perpendicular to the rock face is a function of the radius of curvature and the cable tension at any given point.

Modeling indicates that this first implementation apparatus should be able to cut a 100 foot tall vertical slot upward from the horizontal lateral with a cut length possibly exceeding 2500 feet. This apparatus can operate in a blind hole from a conventional drilling rig and be powered by the drilling rig. Special apparatus to practice the method would include a cable tensioning means and a down hole shoe tool that connects the abrasive cable to the end of the drill pipe. The shoe tool preferably has a mechanism that can release the cable after the slot is cut or if the cable should break. The method utilizes directional drilling services of standard industry skill to drill a hole whose bend radius is closely controlled. The hole may be as straight as possible down to the target formation and then begin a long increasing radius curve through the target formation. The hole may bend in a vertical plane but can also turn in a horizontal plane to create a horizontal cut. The tension on the winch and the bend radius of the hole may be adjusted to produce a substantially uniform cutting force all along the curved portion of the hole, resulting in a uniform cut depth along the curved hole.

Figure 2:
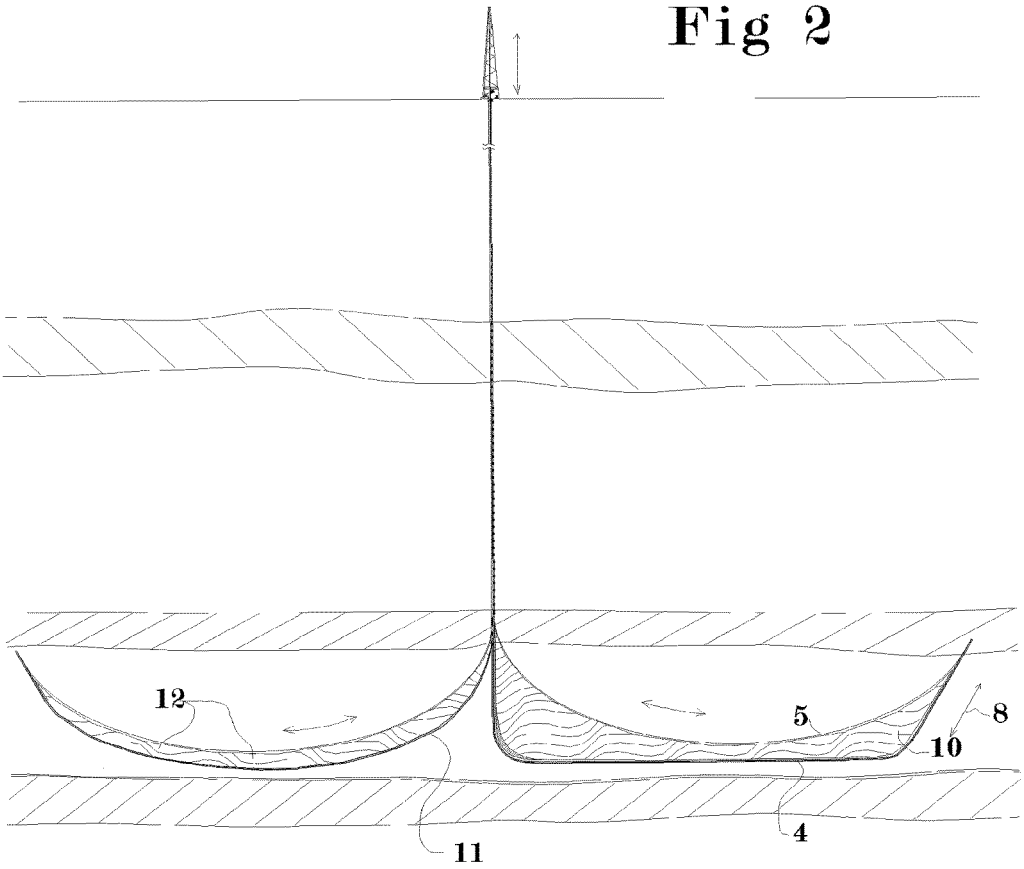
In FIG. 2 the horizontal run of the pipe 4, in the hole is extended and turns 45 degrees upward or to one side at the end. This geometry change allows the cable 5, to cut a much larger area 10, as it is reciprocated through the same stroke 8. A second horizontal lateral hole 11, branches off to form a shallow arcing curve along the formation instead of traveling on a true horizontal path. In this hole the wire rope cable cuts a more uniform depth 12, along the hole.
Figure 30:
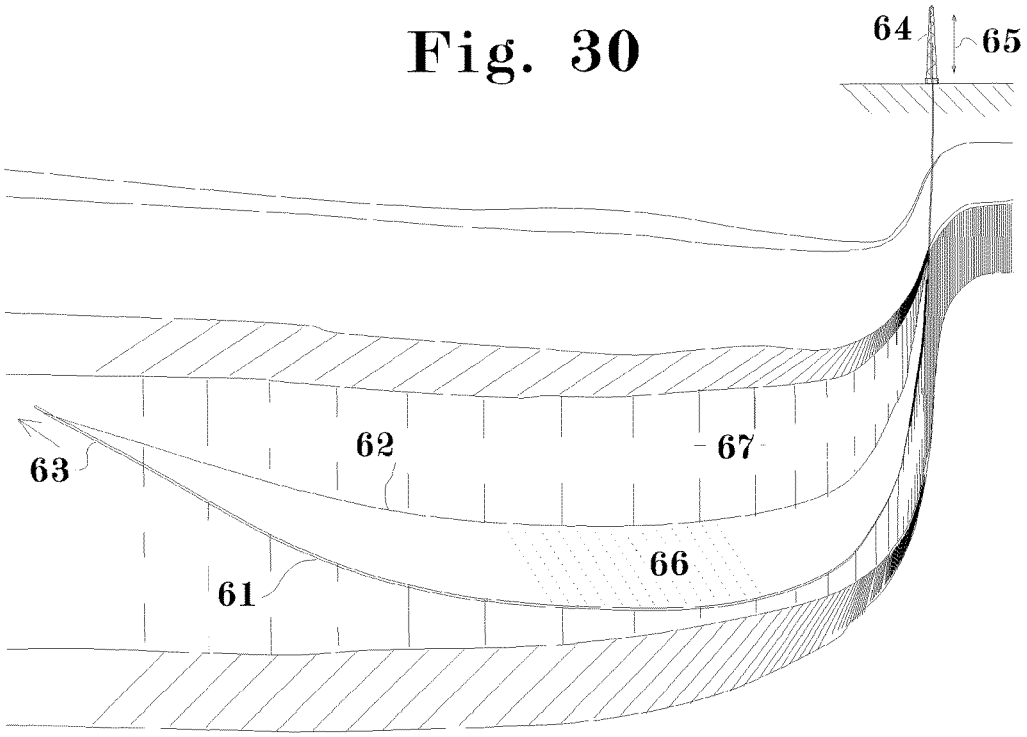
FIG. 30 shows the method wherein a drill pipe 61 is attached to an abrasive cable 62, by means of a tool 63. The drill pipe is reciprocated by a drill rig 65 through a stroke 65 resulting in a cut slot 66 within the earth formation 67.
Figure 31:
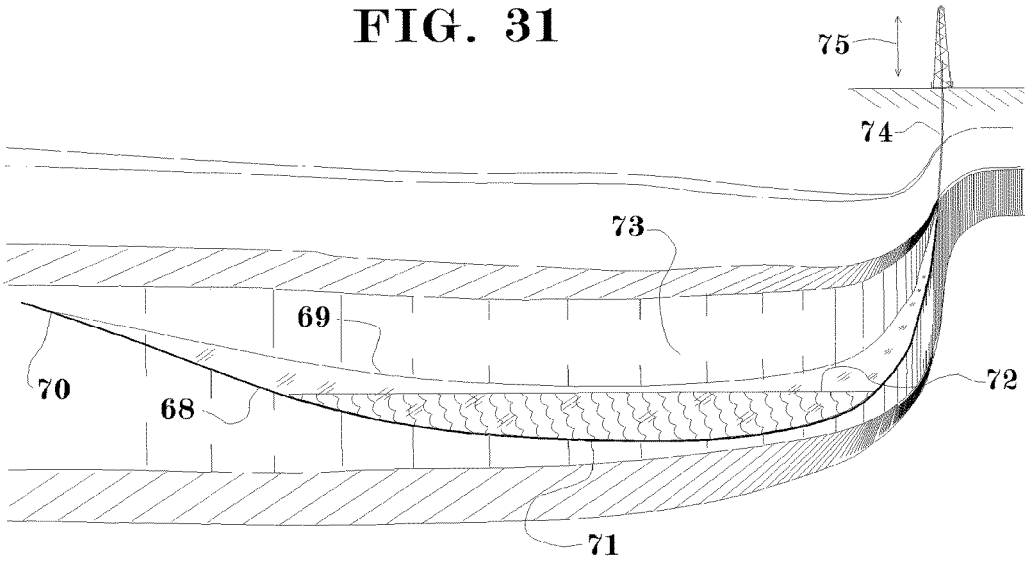
FIG. 31 shows a similar cut through the formation 73, wherein the cut formed by the stroke 75 of the abrasive cable 69 is at least partially filled with fluid 72, which is being displaced by compressed gas delivered from the surface 74, into the drill pipe 68, through an opening 71, which becomes open after the opening at the end of the pipe 70 is closed by the action of suitable down hole tools. The fluid may also be displaced by pulling back the tip of the drill pipe 70 to the position 71.

The curve profile of the well can be adjusted to generate more cutting in specific portions of the well. A typical well in prior art would be drilled as straight as possible to the desired depth in the target formation and a casing cemented. The hole would then be directionally drilled to curve like a "J" within the producing formation extending as far as possible in the horizontal plane. If applying the method to an existing hole that goes straight down and then turns 90 degrees to go horizontal, then the abrasive cable would produce cutting force only in the bend as in FIG. 1. FIG. 2 shows a well with two horizontal laterals, one going left and one going right to illustrate two alternate approaches. The one to the right has straight sections with tight curves while the one to the left has a more continuous curve. The one with straight sections will experience initial cutting at only at the curves but will eventually cut an arc between the two bends. However the one on the left side of FIG. 2 with the continuous curve will experience cutting all along the long curve. Cable friction increases along the arc of the curve. If the curve is a constant radius, the cable tension on the down stroke, and thus the cutting depth, will increase along the arc of the curve, at least until it nears the end of the cable. By designing and drilling the hole with an increasing radius curve, it is possible to achieve a substantially uniform depth cut along the curved hole as in FIG. 30.

After drilling the hole, the drill string is retrieved back to the surface and an abrasive cable is attached to the tip of the drill pipe by a special down hole tool. A winch or on the drill rig, or other tensioning means, is configured to hold a specific tension on the cable as the pipe is lowered back into the hole under its own weight. The cable tension while the pipe is running into the hole prevents the pipe from rotating and wrapping up the cable on the way into the vertical part of the hole. The cable tension also causes the cable to hug the inside radius of the curved hole while the pipe compressive loading tends to make it hug the outside radius of the curve. The friction on the cable around the curve multiplies the initial low cable tension from the winch, increasing exponentially around the curved path. The abrasive cable cuts a pathway on the inside radius curve of the hole, typically upward from the hole, on each downward stroke. The cutting force at any point is a function of local cable tension and radius of curvature so the shape of the cut may be tailored to some extent by drilling the hole with a changing radius of curvature. The cut is nominally upward along a vertical path but can also be made to turn horizontally by curving the hole horizontally.

The cable may also be replaced with other types of abrasive elements such as a pipe with abrasive hard facing or a pipe with a fluted spiral or helical shape like those commonly used as a key seat cutters in oil wells. Such a pipe may optionally include a mechanism to provide rotation to only the abrasive member to obtain more even cutting.

The drilling rig may reciprocate the pipe up and down with its full stroke (typically 90 feet) for several days to make the cut, depending on the desired depth of cut and the hardness of the rock. On the up stroke the cable tension is limited to that provided from the winch so the up stroke performs little cutting. Highest cable tension and wear is inherently at the end of the cable near where it attaches to the pipe, so the entire cable may be easily pulled out of the hole in the event of cable breakage. Optionally the shoe tool may be designed to facilitate pulling the broken end of cable out of the hole. The shoe tool at the end of the pipe can also release the cable, when desired, to allow it to be pulled out at any time, even if lateral stresses tend to partially close the slot. The release mechanism may be based on cable tension, an electrical signal, circulating pressure, annular pressure outside the tool versus internal pressure, or a force due to a ball or plug pumped down the pipe. As an example and not by way of exclusion, shear pins in the form of set screws could retain the plain end cable and be designed to reliably shear off at 85% of the minimum breaking strength of the cable. This means of releasing the cable would be desirable for high temperature or geothermal applications because it does not require rubber seals. The end of the released cable is preferably no thicker than the cut pathway so that it may be pulled back through the cut without getting stuck. The cable end could alternately be flat and wider than the cut in one dimension but still thin enough in the other dimension to pass through the cut.

Drilling fluid may be circulated through the drill pipe to flush the cuttings back to the surface. The abraded cuttings are very small particles and may be circulate out the annulus of the hole or up the tubing. Cutting are then removed from the drilling fluid by an oil field type solids control system using filters and hydro-cyclone units as is known in the art. The drilling fluid may optionally contain small spherical solids to add lubricity and reduce friction in the hole. These spherical solids are preferably sufficiently similar in density to the drilling fluid to remain suspended with sizes between 1 micron and 2 millimeters in diameter. Compressed air may also be used as a drilling fluid to circulate cuttings. This may be useful in water sensitive formations.

In some formations it may be difficult to directionally drill the hole along the planned arc or the path of the drill may wobble and not follow as smooth a path as desired. Kinks in the path of the hole add to total friction and may complicate the work. In this case it may be desirable to use one or more key seat wiper tools to smooth out the path of the main hole. Suitable spiral key seat wipers are made by Stabil Drill Company of Lafayette, La. These are typically a heavy section of pipe with a helical ridge or flight on its exterior that is prepared with hard facing material and embedded silicon carbide grit. As these tools are reciprocated in the hole, irregularities in the hole are reduced and small kinks straightened out.

Some formations are not stable enough to stand open while a pipe is reciprocated through them. A fiberglass or other easily cut or abradable pipe material may be installed to case the drilled hole. By way of example, after cementing a steel casing in place in the vertical portion of the hole, a fiberglass casing may be hung and cemented in place in the entire hole or just the curved portion of the hole. The slot drilling string would then be lowered into the hole and it would cut through the fiberglass pipe and cut the slot.

A special tool may be used to assist a standard blow out preventer (BOP) to better seal on the cable and drill pipe. The cable is threaded through a crescent shaped cross section rubber sleeve that hangs along side the drill pipe in the BOP and enhances sealing against the drill pipe. Another approach for annular blow out preventers is to cut a slot into the rubber for the cable to pass. This slot may be manufactured with the rubber element or may be cut by the slot drilling string on the way into the well. When the blow out preventer is activated this gap will be closed and a seal obtained. The portion of the cable in this area may optionally have a smooth exterior impregnated with plastic or other suitable material so that the BOP rubber element can seal on it and so pressure may not flow through the open space in the body of the wire rope cable. Pipe rams may have a special shape with machined rubber faces suited to seal on both the pipe and the separate cable. The cable in the part of the hole above the target zone need not be abrasive and is preferably slick with a friction reducing coating. This slick cable may also be replaced with pipe if a suitable tensioning means, such as a coil tubing injector mechanism, is available. The plastic coated or otherwise sealable slick cable may connect to the primary abrasive cable at some depth between the BOP and the first curved portion of the hole. This attachment junction may optionally include one or more friction reducing devices to minimize friction from a less than perfectly straight bore hole. The friction reducing device may be a plastic or PTFE (Teflon®) cover around the attachment junction and could also be applied to the cable at intervals above this to reduce friction. As the pipe and cable are reciprocated up and down by the drilling rig over a period of several days, these friction reducing devices help prevent wear on the portion of borehole or the casing above the zone where the slot is being cut.

After cutting the slot is complete, the drilling mud may be reversed up the drill pipe by applying annular gas pressure to remove all fluid from the slot and borehole to facilitate natural gas production. If the slot extends past 90 degrees from vertical the drill pipe may be extracted back to the 90 degree point so that fluids may be completely removed. Alternately a suitable reversing valve may be installed in the pipe at this point. Pumping means such as jet pumps and spring loaded pressure driven pumps may also be used. In unstable formations, the drill pipe used in cutting the slot may be left in place and perforated to become the production string to eliminate the need to trip out of the hole. In unstable formations a pre-treatment of the hole while drilling can stabilize the main hole. Pre-treatments could include pumping a grout into the surface of the exposed formation to stabilize it. This could also include installing an abradable plastic of fiberglass casing in the hole and optionally cementing it in place. The abrasive cable would then cut through the casing and form the slot.

Abrasive Cable and Diamond Abrasives

In soft formations such as shale, coal, or tight sand a plain wire rope cable may be sufficiently durable to cut the slot but in harder rock the cable may be augmented with diamond abrasives. In hard rock, a plain wire rope cable may be modified with diamond abrasives or fitted with diamond abrasive coated beads. Geothermal formations are typically made of very hard rock so diamond abrasives are needed to cut economically. The diamonds abrasives are fixed to the external surface of the wire rope. The diamond abrasives may be embedded on the outside of short metal tubes, called "beads" that slip over the body of the wire rope cable. These beads may be crimped to the cable or separated by springs or a rubber coating over the cable between beads. Diamond abrasive wire rope with the required tensile strength is not commercially available but can be made using existing technology. The abrasive cable may be any size but would typically be from ⅜ inch to 3 inches in diameter. A typical abrasive cable with diamond abrasive beads fitted over a 1 inch diameter high strength wire rope may have a diameter of 1.5 inches. The diamond abrasives could be similar to those used in diamond wire sawing of stone and concrete. The beads are nominally separated by metal compression coil springs that absorb shock loads and provide sufficient friction to resist the beads from rotating with respect to each other.

By way of example and not as a limitation of sizes, a 1 inch diameter wire rope cable with 1.5 inch diameter diamond abrasive beads separated by annular compression springs may be used as an effective cutting tool. The beads are nominally free to rotate on the cable but resist rotation due to friction with the springs and a crimp bead positioned periodically along the cable. As the cable is tensioned the wire rope tends to twist due to its multi-stranded construction. This twisting effectively rotates the diamond abrasive beads back and forth along the axis of the wire rope cable so that the beads wear more evenly. At intervals along the cable a swedged steel sleeve will secure the adjacent beads against rotation. The cable itself will rotate back and forth due to the changes in tension. This rotation will serve to rotate the beads relative to the cut and produce more even wear on the beads. Any suitable method may be used to secure the diamond abrasive elements to the cable so that as the cable twists back and forth the diamond abrasive elements will rotate within the cut to even out wear on the beads.

As diamond abrasive beads wear the cable cut width may decrease. If a cable wears out before completing a slot the new cable may be too large to fit through the previously cut slot so it is very desirable that the abrasive elements be able to cut a wider path or squeeze through a narrow cut. Beads may be made with slight variations in wall thickness to help cut a path slightly wider than the bead diameter. The wire rope may optionally be made with at least one of its outer strands larger than the others to produce an eccentric shape to cause uniform beads to cut a pathway slightly larger than the bead diameter. Diamonds are typically pressed into a metal or steel sleeve by hot isostatic pressing techniques. Diamond abrasive beads may optionally be made with a series of angled cuts that allow the steel sleeve to act as a spring and pass through reduced diameter areas. FIG. 40-41 shows one implementation, where the beads have cuts that create a zigzag to increase the flexibility of the steel sleeve. These beads can compress to pass through a narrow place in the cut. The slight angle relative to the bead centerline optionally helps the bead rotate. The diamonds may be embedded in the steel sleeve, before the sleeve is hardened to give it spring steel properties.

The portion of the cable within a few meters of the end that is connected to the drill pipe may receive less wear and this could inhibit the cable being pulled out of the hole after the cut is complete. To avoid this issue, the abrasive beads may be made of a smaller diameter near the end of the cable. Alternately they may be designed to slip off of the wire rope at a high tensile load. The wire rope may optionally have an eccentric construction with one strand larger than the rest to allow the beads to cut a slightly wider path than the diameter of each bead. The diamond abrasive beads may also be made from a spring or other resilient material that will enable them to pass through narrow areas of the slot. For example the abrasive elements could be mounted on a resilient rubber layer on the cable that allows the elements to compress the rubber and squeeze through a tight place in the cut. Another way for the cable to resist getting stuck in a narrow cut is to make the cable more compressible. The beads themselves could also be in the spiral form of a compression spring. Alternately, the metal sleeve, or steel tube that the diamond abrasives are embedded into could have a longitudinal slot cut so that its cross section is like the letter C instead of like the letter 0. The sleeve could be quench hardened into spring steel after embedding the diamonds. The gap could be angled along the length of the bead so that it causes the bead to rotate as it is dragged through the cut. Either approach would allow the abrasive member to compress when passing through a narrow slot.

Another method of cutting a path slightly wider than the nominal cable diameter is for the cable itself to be slightly deformable in the radial direction so that it may flatten out while making a cut. This could be done simply by using a fiber or synthetic core in a steel wire rope. The wire rope tensioned around the curve of the cut would flatten slightly and thus form a cut that is wider than the nominal wire rope diameter. The wire rope itself can cut soft formations such as coal, but in hard rock diamond abrasive embedded beads could be added to individual wire rope strands so that though the rope normally lays flat, the strands can fold together to pass through a narrow place.

Some portions of the cable may be specially adapted for cutting while others may be designed to have a low friction, or a smooth exterior to facilitate sealing through the blow out preventer. The cutting cable extending up to the straight part of the bore hole may be connected to a different type of cable extending back to the surface. The cable that extends to the surface could have a smaller or larger diameter and low friction coating.

Cable Tensioning Means

The tensioning means to maintain constant tension as the pipe enters and then reciprocates in the well may take several forms. The winch may be similar to those used for towing ships in rough seas or those for installing casing while drilling. A traction winch which grips the cable by wrapping it around a capstan drum may be combined with a larger take up reel that can hold all the cable needed. There are many alternative ways to perform this cable tensioning task. The winch's cable reciprocation distance may be optionally be reduced by running the cable over a pulley mounted on the traveling block and then to a winch some horizontal distance from the pipe. A secondary winch cable may grasp the primary cable by means of a lace up wire rope braided cable grip similar to those made by National Cable Grips. Since this tool is above the rig floor it could have an externally powered hydraulic cylinder that maintains the tension in the cable below it, and it could be activated to grab or release the cable by externally powered hydraulic systems. Another method is to replace part of the pipe above the rig floor with a special grab tool similar to the one in FIG. 14-18 that grabs the cable and maintain tension after the winch has pulled it tight. During normal cutting the grab tool tensioner mechanism provides the needed tensioning, but when it reaches the end of its travel, stroking is stopped and the grab too releases the cable while the winch is again activated to take up the slack and re-tension the cable before the grab tool is again activated to grip the cable.

One alternative simple way to provide the constant tension during cutting is to run the cable over a pulley in the rig suspending a suitable weight that is free to travel up and down for the required stroke but this is inconvenient and potentially dangerous. Alternately, once the drill pipe has been lowered under cable tension to its full depth, a tensioning means such as a winch or air cylinder may optionally be located on the drill pipe above the rig floor. This reduces shortens the stroke and thus reduces the power requirement of the winch to feed out and pull in 90 feet of cable with every stroke of the drill pipe. An air cylinder made from 20 inch diameter casing would be capable of supplying the needed tension with 100 psi. Tension could be adjusted by air pressure. A tensioning device located on the pipe or the traveling block area moves with the pipe and only needs to feed out and pull in a few meters with each stroke to maintain tension.

The rate of increase of the radius of curvature may be adjusted during directional drilling to provide a near uniform normal force and thus uniform cutting depth along the arc. The greatest tension is near the end of the pipe where the cable is attached. However, this portion of the hole has the least curvature so the force normal to the surface may be kept nearly constant along an optimally curved borehole. This normal force causes the moving cable to saw into the rock in the inside radius of the borehole. A typical blind hole might traverse a total curvature between 60 degrees and 140 degrees of arc.

On the pull-back stroke the cable tension is greatly reduced because there is no tensioning element at the tip of the pipe where the cable is attached. Normally this is good since it reduces the chance of getting the system stuck in the hole. Optionally a tensioning element may be added to the end of the pipe that extends a slip joint on the end of the pipe by internal pressure on the pipe. Other means to apply the tension could also be used. This could be useful for increasing the cutting force on the pull-back stroke if this is found to be economically significant. The tensioning down hole tool described below could also perform this function if it is designed to have a higher tension on the upstroke than the down stroke.

The need for the cable extending to a tensioning means on the surface may be eliminated with a down hole tool as shown in FIG. 14-18 that maintains the uniform tension on the cable near the point where the bore hole begins to curve. Two different types of down hole tensioning tools are disclosed in the drawing herein as examples and not by way of limitation.

Figure 14:
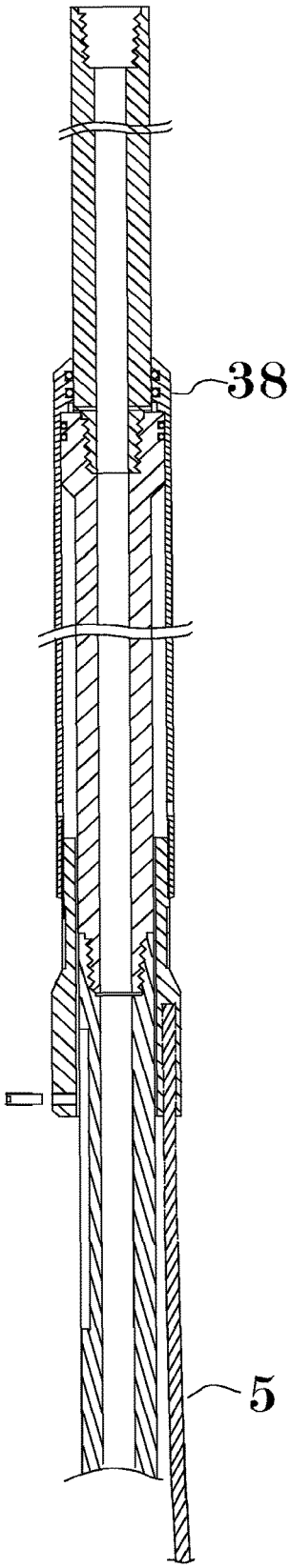
FIG. 14 shows a down hole cable tensioning tool. The tool grips the cable 5, below it and responds to internal pipe pressure by extending a hydraulic sleeve 38, upward that stretches the cable.

The down hole cable tensioning tool of FIG. 14 holds tension on a length of abrasive cable that extends between it and the releasable cable attachment mechanism of the shoe tool. FIG. 14 shows an example of how such a tool could be made to operate on the differential pressure between the inside and outside of the tool when circulating drilling fluid. The fluid enters an annular hydraulic cavity and extends an outer sleeve that tensions the abrasive cable. The advantage of a down hole tensioning tool include:

- No cable passing up through the rig floor or blowout preventer
- No cable tensioning hardware added to the standard drilling rig
- Tension may be applied from a point past initial borehole curves to apply cutting only along a specific length of the borehole such as a horizontal curve Less cable is required since it does not have to extend back to the surface Cable abrasive friction is the same in both up and down stroke so cutting can proceed more rapidly It will be apparent to those skilled in the art of down hole tools that there are several alternative ways to the tool could function. A hydraulic or air powered tool could be have a pressure line extending from the surface. A tool could be operated by a down hole electric motor and with a gear reduction drive powered by electric line or by batteries. A tool could also simply grab and hold tension provided by the drilling rig, and rely on the modulus of a very long cable to maintain tension as the cable cuts the slot. A tensioning tool could be based on mechanical pipe rotation. Such a tool could have a long threaded member that extends the length of the tool when the ends of the tool are rotated in opposite directions.

A mechanical rotation operated cable tensioning tool could tension a sufficiently large diameter cable (2 to 3 inches in diameter) so that cable breakage is unlikely and such a cable could also have diamond abrasives. Length of the cable could be several thousand feet. Installation and operation of such as tool is described as follows:

Running the drill pipe into the hole the abrasive cable is attached to the shoe tool and lowered into the wellbore. The abrasive cable is lowered in at the same time, maintaining enough tension to prevent rotation of the drill pipe. When the required length of cable is in the borehole, the tensioning tool is connected as part of the next joint of pipe to run in the hole. The abrasive cable is connected to the tool and at least partially tensioned. The tensioning may be done by suitable external means such as a winch or cathead. Any excess cable may be cut off at this time. The drill string is lowered further into the borehole adding additional sections of drill pipe.

As the drill pipe travels through bends in the borehole the tensioned cable will tend to orient the pipe with the cable to the inside radius of the borehole. The cable as well as the drill pipe in the bend will produce high frictional contact loads against the rock formation. The drill pipe above the tool may be rotated by the drilling rig. Friction from the cable and from the drill pipe through the bend will tend to hold the tensioning tool and cause it to resist rotation. The rotation of the drill pipe from above the tensioning tool will act on a threaded mechanism in the tensioning tool to increase tension on the cable. The entire tool may lengthen or it may be only a threaded sleeve that moves along the exterior length of the tool.

The length of cable and the elastic modulus of the cable will allow estimation of how much tension is created by a given number of turns. The tension also affects the friction of reciprocating the pipe so the rigs indicator of "weigh on the drill bit" can also be used to infer cable tension. If cable tension is too high and the drill pipe becomes stuck the tension may be released by counter rotation of the drill pipe above the tensioning tool or by releasing the cable from the shoe tool below. The tool may be designed to tighten the cable with left hand rotation and loosen it with right hand rotation or conversely it may be designed to tighten the cable with right hand rotation and loosen with left hand rotation.

Gravel Packing Slots

The nominal width of a slot is envisioned at between 1 and 3 inches for slots cut with an abrasive cable. Wider or narrower slots can be made but may be less efficient. Slots widths equal to the borehole diameter are possible with some of the tools described herein that use an abrasive pipe to cut the slot instead of a cable. Some formations may have sufficient lateral stress to close up thin slots. To counter this, the slot could be filled with sand or gravel by circulating sand laden fluid down the drill pipe to pack the slot full so that it cannot close. This can be done by simply circulating the sand laden fluid down the drill pipe. In a vertical slot, sand will pack off near the end of the drill pipe in the borehole first and then flow will travel through the slot, dropping sand into the lower parts of the slot. Larger sizes of sand up to pea gravel size may also be used since the sand does not have to enter a thin fracture.

The fluids used in the gravel packing work could be water or special fluids designed to have greater sand suspending qualities during application but revert to low viscosity fluid that can be flushed out after the sand is in place. The drill pipe could then be perforated for production. Packing the slot with sand may also be facilitated by retrieving the tools from the hole and replacing the abrasive cable with coil tubing. A special tool joining the coil tubing to the drill pipe would allow circulation of sand laden fluid down the coil tubing to the annulus of a screen section of the drill pipe.

Opening a high surface area slot may produce a significant initial flow of gas or other hydrocarbons. Use of a sufficiently dense drilling fluid to hold the formation in place may also prevent the slot from closing before the sand pack is in place and has the bonus of also controlling gas kicks. This is typically known a overbalanced drilling. When cutting a slot in a hydrocarbon producing well, or simply a well containing water sensitive clay, it may be desirable to circulate hydrocarbon liquids or oil based drilling fluids rather than water based mud to remove cuttings and cool the abrasive cable.

Construction of slots may enhance performance of many different types of wells.

Gas wells in low permeability shale

Gas wells in coal beds

Gas wells in tight sands

Oil wells

Oil Shale in situ conversion

Water wells

Injection wells

Geothermal wells

Interceptor drains

Environmental remediation system wells

Sequestration of carbon dioxide in underground formation strata

Gas Shale Application

It is known that shale rock formations often contain large volumes of natural gas but the relatively low permeability of these formations sometimes limits the recovery flow rate of the gas to non-economic quantities while leaving behind significant unrecovered gas. The low permeability of the rock near the well bore prevents the rest of the formation from being exposed to significant pressure drop from the well bore.

This problem has previously been addressed by drilling holes that turn horizontal at depth and travel within the relatively thin shale formation layer. Electronic tools run within the drill pipe are able to track the position and progress of the hole and its proximity to the shale formation layer interface. Hydraulic fracturing is then used to increase the surface area of these wells by fracturing at intervals along the horizontal well, but it is difficult to control the direction or orientation of such fractures. This lack of control may lead to un-even and incomplete recovery of gas from the leased formation. Large areas of the formation may remain too far away from the fractures for effective gas production. Fracturing the wells too vigorously may also risk creating flow paths to adjacent formation layers containing water. Water from an adjacent formation layer entering the well can reduce the flow of gas to the surface. Large volumes of water are required for the fracturing process and the water use and disposal may become an environmental problem. Pumping very large volumes of water into a formation with no certainty of where it will go may expose the operator to pollution liability claims.

Cutting a slot into the formation provides a cost effective means of increasing the amount of gas that may be economically recovered from a given lease acreage area of a subterranean shale, sand, or coal bed formation, while minimizing the cost and environmental impact. A further objective is to maximize the total recovery of gas from a given area by accessing a larger percentage of the total reservoir volume. Since the slots may be placed in a precise pattern, with known spacing between slots more of the total formation volume will be within flow range of the gathering network formed by the slots. Slot cutting methods may also be applied in conventional oil and gas producing wells and water wells.

Oil Shale Application

Oil shale is a sedimentary rock that contains a significant proportion of Kerogen, which when heated can be converted to oil. In the present invention, adjacent parallel slots may be formed in an oil shale formation and filled with salt water, conductive pipe, or a suitably conductive proppant such as coal, carbon black, coke chips, charcoal, or graphite fibers so that an electric current run between the adjacent slots to heat the oil shale formation. Over time the resulting oil and gas could then be produced from the slots. Microwave energy could also be propagated from pipes placed within the slots to heat the formation. The slots may also be heated by process heat from combustion from a surface unit or combustion occurring in the slot itself. Process heat could also come from direct combustion, a nuclear reactor, a concentrating solar collector, or electricity generated from wind. The hot gas or fluid may be circulated down the pipe in the original drilled hole and back through the slot to the annulus of the vertical portion of the hole. Optionally, superheated gas may be circulated through the open slot itself from a pipe in the original well bore. In this method the hot gas will volatilize the oil shale and convert it to a gas in place, that can be circulated to the surface for recovery or use in generating more combustion heat. Optionally a secondary hole may be drilled from the surface to intersect the distal end of the slot to allow circulation of the process heat through the slot.

Brief Description of Geothermal Application

The slot which is formed by the methods described herein not only make it possible to extract mineral resources such as natural gas but also makes it possible to extract thermal energy resources from hot rock. A slot allows a very large heat exchanger means to be placed in the slot in direct contact with a large cross-section of a hot rock formation. Having a very large heat exchanger down in the slot itself allows it to gather heat with a relatively low thermal gradient so that mineral precipitation and corrosion are reduced. This produces a more sustainable engineered geothermal reservoir with a larger heat transfer area than conventional methods which inject water through fractures to gather geothermal heat.

The slot cutting method may also be applied to extraction of geothermal energy from the earth. Geothermal energy is essentially mining of heat trapped within the earth. In practice this generally means mining the heat within a specific volume of rock coupled to one or more well bores. Thermal conductivity of the earth is generally not sufficient to transfer heat to a well in sufficient quantity for commercial generation of electricity unless the well bores can be coupled to the rock by a network of fractures. Attempts to do this by fracturing between one well and another and directly circulating water, have not been very successful. After circulating water through the fractures for a year or two the fractures tend to cool off. The large volumes of cold water injected at high pressure into the rock tends to create shortcuts and may even cause small earthquakes.

In the present invention a closed loop heat exchanger loop is placed in each slot. The slot is cut and a piping loop is placed within the slot to form an engineered geothermal reservoir. This loop may take heat to the surface to another heat exchanger that runs power generation equipment or other applications. The fluid in the closed loop remains relatively hot even when being circulated back down the loop. The engineered geothermal reservoir may comprise multiple planar slots across a rock formation to create a thermal transfer system that accesses a much greater portion of the natural fractures in the formation than can be achieved with conventional fractured wells.

In geothermal applications the hole may optionally be drilled with steam, compressed air or foam instead of fluid to cool the abrasive cable and remove cuttings. For completion of a well for geothermal heat mining applications, the drill pipe and abrasive cable may be removed from the well after the slot is cut and replaced with a drill pipe 76 and 79 of FIG. 32, having one or more lengths of coil tubing 84 and 85 of FIG. 33, attached to its end such that fluid may be circulated from the drill pipe to the coil tubing. This coil tubing fits into the slots and acts as a down hole heat exchanger heating the fluid being circulated through the tubing. The coil tubing diameter is at least slightly smaller than the abrasive cable and may be tensioned in the same way as the cable to position it toward the top of the cut. This arrangement provides a closed loop circulation path to collect heat from the formation.

A secondary pipe or coil tubing may be used to inject or to extract fluid from the slot to stimulate fluid mass transfer 80, between adjacent slots. A modification of the tool connecting the pipe to the coil tubing may be used to inject sand or gravel laden fluid into the slot to help filter out sand produced by a formation. Multiple adjacent slots in a hot rock formation may connect to sufficient natural fractures to allow water injected into one slot to pass though intervening rock and carry heat to the next slot as in 80 of FIG. 32.

The engineered geothermal reservoir concept may be applied in a wide range of geographic locations including areas where the hot rock is very deep such as in non-producing oil and gas wells. In this case the formation fluid that transfers the heat may also be a liquid hydrocarbon. Compared to water or brine, use of the natural liquid hydrocarbon for heat transfer within the formation may help prevent corrosion, scaling and plugging of formation fractures with precipitated minerals. For example an existing vertical well that produces too little oil and gas to be economic could be converted by drilling it deeper with a directional drilling tool that begins with a given radius turn that increases in radius with time such that the curve flattens out after traveling a few thousand feet. A slot cutting string could be installed in the hole and begin cutting a slot all along the new portion of the hole while not cutting into the existing casing of the original well. Slot cutting in such wells could be done with hydrocarbon based fluids to circulate the cuttings instead of water based drilling mud.

Figure 32:
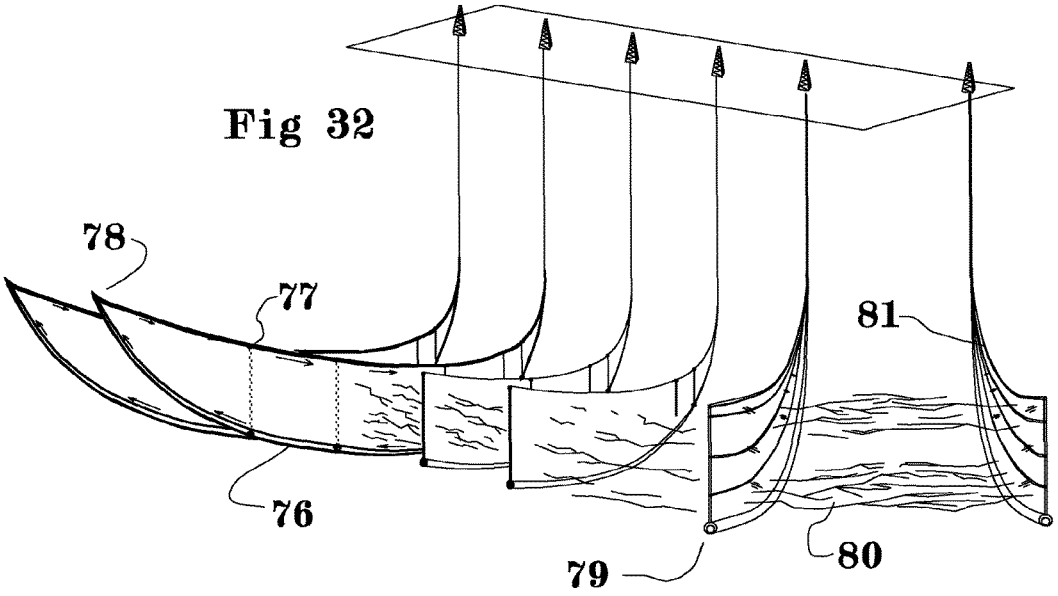
FIG. 32 shows multiple substantially parallel slots cut in the earth from separate vertical holes. Each slot has at least one pipe 76 and at least one coil tubing 77 connected by a tool 78 inserted into the completed slot to form a engineered geothermal reservoir panel. Fluid flow through the pipe, shown cross section view 79, carries fluid to multiple coil tubing pipes 81, that circulate the heated fluid back to the surface. Water flow through fractures 80, transfer heat from the rock to the slots.
Figure 33:
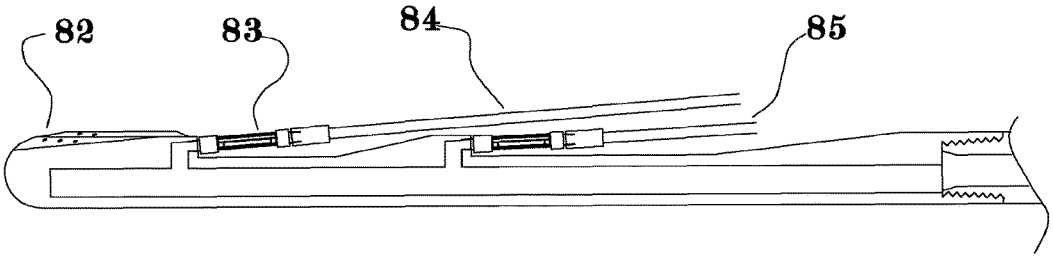
FIG. 33 shows a detailed view of the tool that connects the pipe to the multiple coil tubings. The shoe piece has a ridge shape 82 that helps orients the tool with the slot. The coil tubings 84 are connected by an optional flexible metal bellows hose 83.
Figure 34:
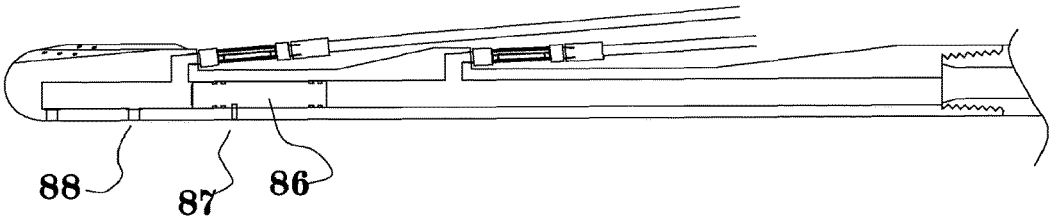
FIG. 34 shows a similar tool adapted for gravel packing the slots. A piston 86 is held in place by a shear pin 87. Flow through the first coil tubing can distribute sand laden fluid through port 88. After the pipe is pressurized to shear the shear pin the piston moves to allow fluid to circulate up both pipes in either direction to remove the sand from inside the pipes.
Figure 35:
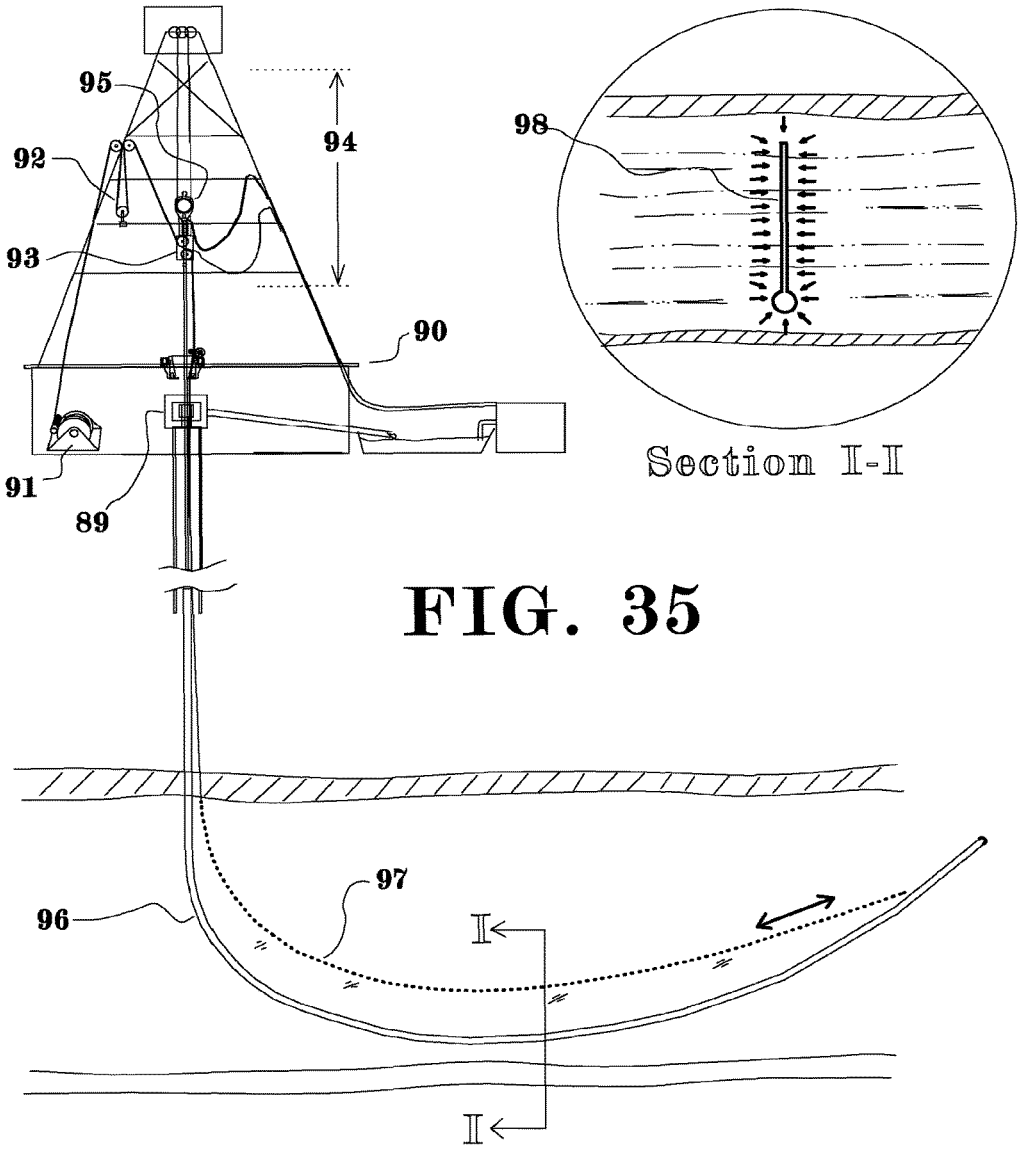
FIG. 35 shows a conventional rotary drilling rig with a special traction winch 93 that is mounted on or around the traveling block 95 so that it moves up and down with the drill pipe through the rigs normal stroke 94. The spooling winch 91 feeds cable to the gravity take-up mechanism 92 which then feeds cable to the traction winch 93 as needed. The traction winch does not have to move very fast to maintain cable tension so it does not require high horsepower like the winch in FIG. 36. Below the rig floor 90 the blow out preventer 89 is modified with a slot in its rubber compression element so that it can seal on the cable along side the pipe if required.

One of the envisioned engineered geothermal reservoir designs of the present invention comprises a parallel series of vertical planar cuts, FIG. 32, in a hot wet formation that are formed the cable saw tool previously described. Each of these planar cuts may typically provide on the order of 400,000 square feet of surface area in the thermal zone. The vertically oriented parallel cuts could be between 50 and 2000 feet apart and intersect many of the natural or artificial fracture pathways between slots. Every second slot could optionally be slightly lower and function as an extraction well removing formation water at the bottom of the slot that is then injected in the uphill adjacent slot to generate a thermal groundwater flow between adjacent slots. The water could be removed by a jet pump or a spring operated pump that is energized by pulses of pressurized liquid or gas from the surface. Such pumps preferably have few or no parts degraded by high temperature. Extraction slots would also contain the closed heat transfer circulation loop that gathers the heat delivered by the water infiltrating into the slots.

In relatively thin slots a special tool may be needed to connect the drill pipe to the abrasive cable to cut the slot. To complete a geothermal well, this tool string is removed and replaced with one that has a length of coil tubing in place of the abrasive cable. A special tool is used to connect the coil tubing to the drill pipe. Multiple coil tubings may be connected to one drill pipe and each tensioned so as to position them at a different depth within the slot. This configuration is illustrated in FIG. 32 and the tool to connect the coil tubing to the drill pipe is illustrated with only 2 pipes in FIG. 33. An insulated conductor pipe in the vertical portion of the hole would prevent heat loss from the smaller pipes inside it. The conductor pipe could optionally be made with one pipe inside another and a vacuum between the pipes to achieve superior insulation. Insulating centralizers between the inside and outside pipes could keep them from touching.

Detailed Description of Geothermal Application Embodiment

Natural geothermal reservoirs where heat is very near the earth's surface produce hot water that can be used as an energy source for electrical generation. Suitable geologic conditions for natural shallow geothermal reservoirs are rare but at greater depths heat is available over most of the planet. However daunting technical problems have limited the utilization of this heat resource.

Artificial fracture systems tend to allow for a preferential flow that mines heat from a much smaller area than intended so they tend to cool after a few years. Waters present in the geothermal formation are often corrosive and tend to deposit mineral scale on equipment they come in contact with. High temperatures of up to 300 Celsius greatly limit the types of equipment that can survive in a geothermal well. Rock in geothermal areas is often very hard and has many dry fissures that can interfere with conventional drilling and completion methods. A further object of this patent application is to disclose how the method to cut large slots makes possible a more durable and sustainable geothermal energy extraction means.

An engineered geothermal reservoir is a system to mine heat from a large subterranean area and transfer it to the surface. A simple pipe running through a hot rock zone has too limited a surface area to capture enough heat for commercial power generation. The rock within a 30 foot radius around the pipe could cool in only a month and the inflow of replacement heat from the earth could take a year due to the relatively poor thermal conductivity of typical rock. It is desired to circulate water through a hot rock formation from one injection point to another to mine the heat from a large volume of the formation rock. Prior art methods have generally tried to create fractures from one well and try to drill through as many of these fractures as possible with a second well. However this approach is far from satisfactory as the temperature of the water circulated along the fractures tends to drop within a few months. Part of the problem is that the low thermal conductivity of the base rock prevents heat from being drawn from a distance.

An engineered geothermal reservoir constructed by using the present invention forms a series of vertical planar slots, alternately called "panels", in a suitable rock formation. The panels would have a very large surface area and pass through many existing fractures in the rock formation. They act as a giant radiator within the formation. Thermal transfer can be greatly enhanced if water can be pumped through the formation to the panels. Even a very slow flow of water through the hot rock will carry a tremendous amount of heat to the panels. The water flow could be through natural permeability and micro fractures within the rock or through artificial fractures.

Slots herein called "panels" on the order of 2500 feet long by 100 feet high are envisioned. Each panel would have a pipe that descends through a vertical borehole, runs along the lower edge of the panel and then returns along the top edge of the panel to the same borehole and back to the surface. The panels are preferably oriented to take advantage of any natural fracture planes, but may also be enhanced with artificial fractures perpendicular to the plane of the slots. These vertical planar slots would extend through a pre-fractured formation to create a thermal transfer system that accesses a much greater portion of the fractured formation than can be achieved with conventional wells. Each panel is made from a vertically oriented slot and contains at least one closed loop of pipe to circulate heat transfer fluid, such as water, supercritical carbon dioxide or other refrigerant, fluid through the panel and back to the surface to extract formation heat. The panels preferably cross the majority of the natural rock fractures. Additional fractures may be generated in the formation before the panels are constructed. The panels contact a much larger total cross sectional area of the rock formation than drilled holes so they also contact a greater percentage of the natural or artificial fractures.

It is desirable to pump water out of some slots and into other slots to stimulate flow of water to carry heat to the slots. Since the piping loop inserted into each slot for heat recovery is a closed loop a second pipe is required to remove or inject water to the slots. This can optionally be a separate pipe or a concentric pipe around the primary pipe in the borehole. The concentric pipe preferably extends to the lowest point of the slot. A pumping means is also fixed at this point to draw down the water in the slot. The pump could be a retrievable Bernoulli Effect type jet pump that has no moving parts or elastomeric seals.

Water is injected into some panels and allowed to flow through the formation to the adjacent panels where it is extracted and re-cycled. The extracted water may be treated to remove at least some of its dissolved solids before reinjection to reduce precipitation of minerals in the fracture network. Excessive treatment may tend to cause dissolution of minerals in the formation and open up the permeability of the formation too much so the degree of treatment will be monitored and engineered to improve the formation characteristics. The direction of water flow may be reversed from time to time by pumping out of the injection wells and injecting into the extraction wells to back flush the formation and maintain optimal flow characteristics. Diverting agents such as metal foil, ceramic or glass beads, plastics and fibrous materials may be injected as needed to block flow through enlarged channels that decrease reservoir uniformity. Neutral buoyant spheres or blocks of various sizes may be used to automatically seek and partially plug fracture systems which flow faster than average.

Geothermal Loop Piping and Circulation

Regardless of the cable saw configuration used to cut the panels, a closed piping loop must be installed in the cut slot to form each heat collection panel. For the blind hole concept the drill pipe and cable would be removed and replaced by a pipe that has a length of coil tubing or other small diameter threaded pipe in place of the cable. The coil tubing would be tensioned as the pipe is inserted in the hole so that the coil tubing bears on the inside radius of the cut formed by the cable saw. The coil tubing is preferably of a smaller diameter than the cable saw so that if the slot has partially closed due to formation relaxation the coil tubing will not get stuck. The coil tubing would have a fluid connection to the pipe such that fluid may be circulated down the pipe and back up the coil tubing. Tension on the coil tubing as the pipe is lowered into the borehole prevents the coil tubing and the pipe from twisting around one another. At least a portion of the coil tubing in the straight part of the hole back to the surface could be replaced with ordinary threaded pipe.

Another two pipes are then added to the slot containing the installed closed piping loop. One is an extraction pipe that extends into the slot area and may be used to inject or to extract water from the slot and the other is the power pipe that powers the pumping means on the end of the extraction pipe. As previously stated, these pipes may optionally be concentric around the primary pipe or simply banded to it. The power pipe carries electrical, mechanical motion or pressure energy to generate a flow of water up the extraction pipe. The pumping means should preferably operate at up to 300 degrees Celsius. At this temperature sealing and bearings becomes problematic. Means to operate said pump could include:

- A reciprocating rod from a pumpjack at the surface operating a piston/ball mechanical pump.
- A jet educator powered by pressurized fluid from the surface
- A rotating pump operated by a hydraulic motor cooled and powered by pressurized water from the surface
- An oil field style air-lift system powered by compressed air from the surface
- An electric submergible pump
- A pump operated by rotation of a member to the surface.
- Air pressure injected into the slot to displace slot water into the extraction pipe at the bottom of the slot.
- A spring operated pump powered by compressed gas or fluid pumped from the surface.

Alternately the pumping means may be integrated into the closed loop flow pipe such that the energy of the fluid being pumped through the closed loop pipe turns a rotor that pumps water out of the slot. A magnetic coupling may be used to avoid the need for high temperature seals on the rotating impeller shaft.

The air lift method is especially useful as a pumping means because it has no moving parts and does not require any elastomeric seals. It is essentially just a jet adductor that injects air through a venturi to force water through a venture. The air reduces the density of the water allowing ambient hydrostatic pressure to push the water back to the surface. A similar method may also be employed with pressurized water driving the adductor.

Flow Between Slots

The large flat slots or "panels" created by the present invention are able to gather much more heat than a simple drilled borehole. However, thermal conductivity of the hot rock alone is generally too poor to allow a panel to economically access heat much more than a few meters from the panel. If panels are spaced a few hundred meters apart much of the heat between them may not be captured. However if even a small flow of water permeates across the space between panels it can transfer large quantities of heat from the rock to the panel. In the present disclosed method, a pumping means pumps water out of some panels and back into adjacent panels. This water flows through the formation back to panels where it is being extracted to capture heat from the rock between panels. Many panels may be constructed to operate as a single system with water pumped out of every other panel and injected to the panels in between.

Fracturing

Fractures between adjacent panels may be created by applying a very rapid increase in pressure to the panels. This may be done by filling the panels with a combustible or explosive mixture of pressurized gas and igniting it as previously described. The resulting deflagration or explosion will compress the rock on either side of the panel and momentarily alter its fracture gradient such that fractures will form perpendicular to the plane of the panel. Multiple fractures will then form away from the panel. The speed of the pressure pulse is preferably sufficiently fast that fractures are initiated at the middle of the panel before the edges of the panel are extended. The source of the expanding gas may optionally be from a gaseous, liquid or solid explosive placed in the slot, or from a rocket propellant ignited in the main borehole. One method is to fill the slot with a mixture of air and hydrocarbon fuel such as natural gas, acetylene, or propane at an elevated pressure. An accelerant such as hydrogen, oxygen, or nitrous oxide may optionally be used to increase combustion speed. Explosive materials or solid rocket propellant applied in liquid form and cured in place may be useful to provide controlled pressure in the central areas of a slot while avoiding extending the distal edges of the slot. Fracturing adjacent panels may result in improved connectivity between panels due to deeper fracture gradient modification of the rock or a partial displacement of the rock between panels into an adjacent panel.

During construction of each panel, the cooler water will eventually cause the face of the slot to develop a network of shallow shrinkage fractures much like a mud flat drying in the sun. Explosive or propellant driven fracturing methods may be applied to the slot to generate multiple fractures perpendicular to the plane of the slot. The slot may be filled with an explosive atmosphere at a pressure below the fracture gradient. When the mixture is ignited the pressure shock wave will exceed the fracture gradient in many places at once within the plane of the slot.

Various orientations of panels are envisioned since the panels may be formed in many shapes. The panels may be a series of parallel vertical slots stacked like a battery and spaced a few hundred meters apart or they may be configured in annular rings or flat sided perimeter shapes. A single vertical hole may fan out into a finned pipe shape with many vertical panels, for example one hole every 15 degrees in plan view. See FIG. 38-39. In this case it may be desirable to have a more constant radius curve so the slots get deeper with distance from the main hole. Flow may be reversed to back flush the rock fractures or to facilitate chemical treatments. Optionally each new panel could begin at a slightly lower elevation to obtain a boost from gravity flow, with pumps at the bottom and injection at the top. The closed loop circulation pipe in the slot where water is being injected may also be used to extract lower grade heat. Injected water may be at least partially de-mineralized so that over the course of time the minerals in the pathway to the next panel are dissolved so that that pathways leading to the next panel become more permeable than pathways leading off into the rest of the formation.

The closed loop pipes may be filled with water or other suitable heat transfer fluid. This piping loop continually circulates hot fluid between the panel and the surface equipment. Only a fraction of the heat is drawn off before circulating the fluid back through the loop. Precipitation scale on the outside of the closed pipe could reduce thermal conductivity. This pipe system within the underground panel is preferably designed to have a relatively small external temperature change within the panel to minimize scale deposits forming on the outside of the pipe. This may be facilitated by insulating the pipes in the straight portion of the bore hole back to the surface. A vacuum between concentric pipes would be one possible insulation method. A second heat exchange system at the surface may be used to run turbines to generate electricity. The pipes inserted in the well may be removable for maintenance. The connection between the drill pipe and the coil tubing is designed to be weak in tension so it can break away to allow each pipe to be pulled out separately.

After a slot is cut, a loop of transfer pipe would be placed into the slot to provide a circulation loop for the working fluid to remove heat from the slot. This can be done using a suitable tool that connects a length of coil tubing to the shoe of the drill pipe much like the cable is connected for cutting the slot. The attachment point may optionally use a metal bellows hose to achieve greater flexibility if required. The shoe of the tool may be shaped to help it align with the slot. Multiple coil tubing's may be attached to the shoe tool. The coil tubing extends back to the surface and is of measured length so that they may be tensioned to position them vertically in the slot. As many such coil tubings as needed could be used in each slot to fully access the heat flow. The cutting cable is preferably larger than the coil tubing to allow good clearance even if the slot partially closes. Pressurizing the slot may be a means of opening up a slot that has closed too far to allow access with the pipe and coil tubing. The drill pipe and its attached pipe are lowered into the hole in the same manner as the drill pipe and cable with tension being held on the coil tubing to prevent twisting and maintain orientation.

The working fluid, which could be plain water, brine, oil, or wax, is circulated down the drill pipe, which is on the bottom or outside radius of the bore hole, and up through the coil tubing, which is on the top, or inside radius of the slot, back to the surface. The drill pipe may optionally be configured as a dual string that can inject or withdraw fluid from the slot. When multiple coil tubings are connected to one drill pipe, at least one of the coil tubings may be used to inject or withdraw fluid from the slot.

A similar set of pipes and shoe tool may be adapted for work in hydrocarbon producing formations that produce excessive sand flow. The current practice for conventional wells is to gravel pack the producing zone. This means installing a production pipe section made of screen wire and filling the annulus with graded sand. The pack of sand provides a tortuous pathway and filters out the sand before it enters the production pipe. To apply this concept to a slot 100 feet or more away from the production pipe is more complex. The coil tubing would connect to the shoe tool on the production pipe as in the geothermal version of the tool but the shoe tool would optionally contain a circulation valve that would cause the fluids circulated down the coil tubing to flow into the annulus around the production pipe screen. The sand would fill the area around the production pipe and then fill the slot. After the slot was packed with sand, the circulation valve would be activated and the opening to the annulus would be closed and replaced by circulation from the coil tubing to the production pipe.

U-Loop Hole Embodiment of the Method

In addition to the blind hole method described above, under some conditions it may be possible to construct a "U-loop" shaped hole that curves back to the surface and then to move a cable through the hole under tension from the surface at both ends as envisioned in prior art. The hole may be constructed by drilling a complete loop curve from a single location or by drilling two holes which intersect at depth. This hole configuration may allow greater flexibility for installing a large number of individual coil tubing's within the slot as in FIG. 42. Each tubing may have both ends extending back to the surface so that separate tubes that leak can be isolated. A slot with a vertical height of 300 feet may need 30 separate tubing's every 10 feet of vertical height, hanging in a catenary arc 115, between the holes 116, that rise back to the surface.

Low angle U-loop holes are routinely drilled under rivers but the hole begins and ends at an angle of less than 45 degrees so the total included angle is less than 90 degrees so friction is much less of a problem than in a full 180 degree bend. However to access a deep formation use of angle drilling adds substantially to the footage to be drilled so vertical holes may cost less, as drilling technology advances. Such a hole could go straight down to the target hot formation and have a U-loop curve within the target formation before coming back to the surface through a straight hole. This approach tends to make a very tall vertical slot that is less suited for gas shale but could be useful for geothermal applications. A total arc of 180 degrees would result in the hole curving back to vertical, but the greater contact arc would increase friction dramatically and may result in the cutting cable getting stuck. For formations at shallower depth, a hole that begins at an angle and curves through the hot formation before returning to the surface at a similar angle, like a river crossing hole, provides a smaller total contact angle and less friction. This is the most technically feasible way to install a U-loop.

To reduce the friction to manageable levels under the "U" shaped hole concept, a friction reduction means such as down hole pulleys or a lubricating fluid in the hole may be employed. Down hole pulleys present serious mechanical issues but spherical friction reducing particles may be added to the drilling fluid to reduce drill pipe friction. These spherical particles may be hollow glass microspheres, plastic balls, spherical fly ash particles, spherical carbon beads made from coke, or other manmade material. For Geothermal applications, hollow spherical flyash particles, in a gas or foam drilling fluid are envisioned.

If a diamond wire cable has a relatively low coefficient of friction, then a hole of greater than 180 degrees arc may be possible such that both ends of the hole emerge at the same surface location. This is desirable because it may allow the cable to be circulated in one direction without the need to reverse the cable motion repeatedly and coordinate winch systems at two separate surface locations as is described in U.S. Pat. No. 4,442,896. The total length of the abrasive part of the cable can also be longer. Running a continuous loop of cable is potentially useful in geothermal applications where the hard rock may rapidly wear out a shorter cable. Another option is to spool a significant length of abrasive cable at each end of the hole and reciprocate the cable in very long strokes. Since the hole has two ends, drilling fluid must be circulated from one end to the other. A drill pipe in the hole is not required and so there may be less risk of collapsing the main borehole due to the reciprocation of the drill pipe.

A "U-loop" shaped curve bore hole path would result in the bulk of the cutting on the end of the hole where the cable is being pulled out. This would tend to cut into the vertical part of the hole on the end from which the cable is being pulled, because the cable tension increases around the arc of contact due to friction. Reciprocation of the cable back and forth would tend to even out the cut and maintain a more symmetrical shape but would still tend to cut into the sides of the vertical portion of the holes.

Friction reduction pulley sheaves placed on the lower extent of the casing could prevent the cable cutting in to the casing but pulley sheaves for a large diameter wire rope cable generally need to be relatively large diameter to avoid rapid wear to the cable and so require a larger diameter hole to install. Large diameter holes are generally much more costly. This problem may be at least partially resolved by fabricating a section of pipe that contains small internal rollers that provide the functionality of a large diameter pulley as the pipe bends from the straight vertical section into the curve. The cable passing through the pipe touches only the rollers so there is minimal friction compared to running inside the pipe itself or an open borehole through rock.

It is more desirable to drill a hole vertically down to the desired depth and then curve through the target formation with increasing radius which then straightens out once it is heading back to the surface at a total angle of less than 180 degrees. For example a hole with 140 degrees of total arc would come back to the surface along a straight hole that was inclined 40 degrees from vertical. At the top of the exit hole a system could be placed to spool a length of the abrasive cable or it could be a continuous loop passed over roller sheaves back to the first rig and circulated back down the hole. A continuous loop of cable is created by a long splice such that its diameter is no more than the other cable and has full strength.

Directional drilling of a "U-loop" shaped hole with vertical sides having substantially 180 degrees of arc is very challenging. In addition to the frictional forces the force on the drill bit will decline after the hole turns upward toward the surface. Maintaining "weight" on the drill bit can be done by using heavy weight drill collars in the initial downward vertical portion of the hole. Friction reducing agents in the drilling fluid will be needed. Rotating the drill bit while it passes through a 180 degree bend may place significant stress on the threaded connections. When the drill bit breaks through to the surface, the drill will lose the ability to circulate the mud in the well. In most cases, a rig must be set up over the pipe exit position and a surface casing installed to protect ground water. The surface casing hole may be drilled by a washover pipe or by a reamer system. Alternately the original drill pipe may be used to pull a casing into the vertical portion of the exit hole. This casing would need to be cemented in place to protect at least the upper water zones.

Once a U-shaped hole is drilled and surface casing installed it is may still be quite challenging to form the cut due to friction through a near 180 degree bend. One solution is to make the slot cut using the reciprocating drill pipe and abrasive cable method from one drill rig at a time cutting at least half the slot from each side.

Another way to reduce friction when cutting a U-loop is to have a smaller diameter tubing inside each of the vertical casings 116, that internally grabs hold of the abrasive cable. The pipes are in turn reciprocated up and down by a drill rig 117 and 118, over each vertical hole. Since the tubing moves with the abrasive cable there is no friction between the tubing and the abrasive cable and no abrasive cutting in the vertical casing even if the holes are not truly vertical and even if they are not straight. Deep drilled holes often have a slight helical curve so isolating the cable inside the tubing's prevents friction. The tubings can also be lowered at least partially into the curved bottom of the U-loop to reduce the effective arc of contact of the abrasive cable against the rock formation. This can dramatically reduce total friction. The portion of cable which is performing the cutting action can be periodically changed by releasing the gripping device and circulating the cable with a suitable means 118, so that new areas are exposed to cutting. This Tubing Reciprocation U-loop method would be suitable for use with very large diameter cable and drill rigs capable of lifting heavy loads.

The Tubing Reciprocation U-loop method could begin with two separate rigs a few thousand feet apart drilling vertical wells to a hot rock zone and casing and cementing the holes. Directional drilling methods could then be used to extend each hole and level off at a precise depth with horizontal laterals aiming at a midway point slightly off from a straight line between the two vertical wells. The horizontal lateral holes would cross at a slight angle some point minimizing the chance of missing each other due to an error in direction. However the true vertical depth would still have to be accurate for them to intersect. Assuming one well passing over the other, then a Heavy Rotating Pipe slot cutting tool such as in FIG. 29 would be run into one or both holes and used to cut downward from the estimated near intersection point to connect to the other hole.

Abrasive drilling fluid or air with entrained solids could be circulated to round off the sharp edges of the intersection point to form a completed U-loop. A suitable pipe such as drill pipe could be inserted into each vertical well to below the bottom of each vertical casing and optionally as far as the intersection point. A small diameter cable attached to a spherical float could be circulated down the first well's drill pipe, through the joined horizontal lateral and up the second well's drill pipe. This small diameter cable would be used to pull a larger diameter abrasive cable into the U-loop. The large cable could be between 1 and 3 inches in diameter and if working in hard rock could have diamond abrasive beads as in FIG. 40. The drill pipes in both vertical wells would have a clamping means above the rig floor that grips the cable and secures it. As the first drill rig lifts its drill pipe out of the hole it drags the cable through the horizontal lateral and cuts into the rock on the inside radius of the curve. The second rig slacks off weight and allows its drill pipe to drop into the hole with a small resistance. The rigs coordinate their actions to reciprocate the drill pipes, which in turn causes the cable to reciprocate through the horizontal lateral with very high tensile loadings so that it cuts a slot. Drilling fluid may be circulated from the first rig to the second and then back again. The abrasive cable extends out of the top of the drill pipe and over the crown blocks of the rig to a suitable storage winch or spool. Periodically the cable gripping devices at the top of the drill pipes are released and the cable may be advance to expose a new cutting surface. The friction between the drill pipes and the casing or open hole is several times less than the friction between the cable and the rock being cut. The drill pipes may extend into the curved hole far enough to reduce the contact arc of the cable against the rock to keep friction manageable.

In summary, while the above method shows it is certainly possible to cut slots with a U-loop shaped hole using the methods described above, for most cases it is expected to be far more economical to construct blind holes since they only require a single drill rig location.

DETAILED DESCRIPTION OF OTHER VARIOUS ALTERNATIVE EMBODIMENTS OF THE INVENTION

Variations on the method include loading an abrasive member in compression along a curve to generate bearing force against the outside radius of the curve. The apparatus may include both a tensile member and a compressive member side by side in the bore hole to facilitate generation of the tensile or compressive forces. Friction to help facilitate cutting may be enhanced by friction producing devices on at least one of the members or by the friction increase around the curvature of the bore hole. Other possible variations in apparatus are disclosed that utilize the weight of the pipe to help produce the cutting force while reciprocating or rotating a member with suitable abrasive elements.

In the present invention the cuts are preferably formed in blind holes formed from a single drill rig location. In order to cut into the formation the tools must apply cutting force perpendicular to the axis of the initial hole. This force may be applied by gravity, inertia, buoyancy, hydraulic or mechanical expansion of a tool, or by tension or compression of a member along a curved borehole. Implementation of the slot cutting method can take many forms and the cutting tools used may take an overlapping range of different forms. These include:

Wire Rope Saw Tools in the first implementation of the method rely primarily on reciprocation of the wire rope attached to and driven by a reciprocating pipe to cut the slot. These tools must work in a curved well bore with tension causing the wire rope to cut into the inside radius of the curved hole.

Heavy Reciprocating Pipe Tools would not require a curved hole but may use a similar wire rope to control orientation of the tool while running into the hole but allow the reciprocation of the pipe to cut downward from the initial hole using gravity to keep the tool pressed against the rock to cut a slot. If a relatively large size pipe is used, it should be possible to make a light weight cutting tool that is buoyant in the drilling fluid and generates upward force through buoyancy.

Rotary Gravity Pipe Tools may operate in a curved or non-curved hole by relying on gravity to generate the force against the bottom of hole that is at least partially horizontal. Such tools can still cut by reciprocating the pipe but would be specially designed to also utilize the rotational power of the rig to form the cut. They do not require a cable because a specific orientation of the cutting tool is not required. These could also generate lateral force through buoyancy or massive weight.

Rotary Compressive Tools may rely on compressive loading against the bottom of a curved borehole to create side force to cause cutters to dig into the outside radius sidewall of the curved borehole. Similar tools may also generate force in a curved hole by a friction producing element near the end of the tool that alternately places the cutting tools in compression and tension to cut into both the outside radius and inside radius of the hole.

Rotary Tensile Reciprocation Tools apply a tensile loading to a rotary tool along a curved borehole to create the side force to make the tool cut into the inside radius of the curve. A friction producing device with a suitable swivel would be activated at least on the upstroke to produce the tensile force to hold the cutting tool against the inside radius of the curved hole. A Rotary Tensile Reciprocation Tools could generate both tensile and compressive loads by having a swivel and a friction producing device near the end of the pipe. A suitable friction device could be made to produce friction only when circulating drilling fluid, only when rotating or by an electric signal. The above alternate tools would generally cut thicker slots close to the size of the initial well bore. For this reason they are anticipated to be slightly more costly for cutting the same surface area of a slot. This implementation of the method is described more fully later in this application as illustrated in FIG. 43 and FIG. 44. Such tools are robust in construction and simple in appearance and also have the advantage of avoiding the need to have a cable coming up through the blowout preventer and requiring additional tensioning means on the drill rig.

Wire Rope Saw Tools

In contrast to the wide slot formed by the above tools, the basic wire rope saw cutting tool is easily adapted to cut a relatively narrow pathway upward from the initial hole. The reduced volume of cuttings may also be an environmental advantage. A existing shale gas well hole might go straight down to a relatively thin shale layer 4000 deep and then bend 90 degrees to travel 2000 feet horizontally as in FIG. 1. A pipe with a wire rope cable attached to its bottom end may be lowered into the hole with the cable tensioned by a special winch that automatically holds a desired tension as the pipe moves into or out of the hole. The pipe bottom end pulls the cable into the hole while the winch pulls the other end of the cable as it is coming out. The reciprocating pipe acts something like a hacksaw frame with the cable as the tensioned saw blade. The weight of the pipe and additional heavy drill collars in the vertical portion of the bore hole provide the weight to push the pipe around the bend and through the horizontal portion of the bore hole. The cable cuts only in the curved portion of the hole, though the depth of the cut will increase around the curve. This method fails to create a slot all along the 2000 foot long lateral.

A similar hole could be extended by inserting a directional drilling apparatus and extending the hole by turning 45 degrees upward toward the top of the shale layer as shown in FIG. 2. This may create a significantly increased square footage of cut. The cut of FIG. 2 may be substantially horizontal with bends at the end as shown on the right or it may be a continuous arc as shown on the left. As shown in FIG. 2 multiple horizontal laterals may be drilled off the same vertical borehole and they can form an arc or be mostly straight with bends. The advantage of making it a uniform arc is that the cable will cut a more uniform distance into the formation along its length. The arc does not have to be of constant radius and may twist laterally out of the vertical plane to form a cut that is not entirely vertical. The hole in the area to be cut may also form a partial helix or spiral to control the orientation of the cut. Generally, the depth of the cut along the bore hole will increase with arc length but by changing arc radius along the length it is possible to design deeper cuts at any point along the length of the hole if desired.

The cut or pathway is created by the abrasive action of a steel wire rope that is reciprocated along the curved path of the borehole. The cutting force results from the cable tension around an arc. The friction of a cable around an arc is increased by a factor of natural log e, (2.7183) raised to the power of, (the coefficient of friction times the contact angle in radians). In calculating friction around a curve, the radius of curvature does not matter, only the contact angle, the cable tension and the total degrees of curvature. The total contact arc is preferably kept relatively low to avoid the steel wire rope cutting cable becoming stuck.

Figure 3:
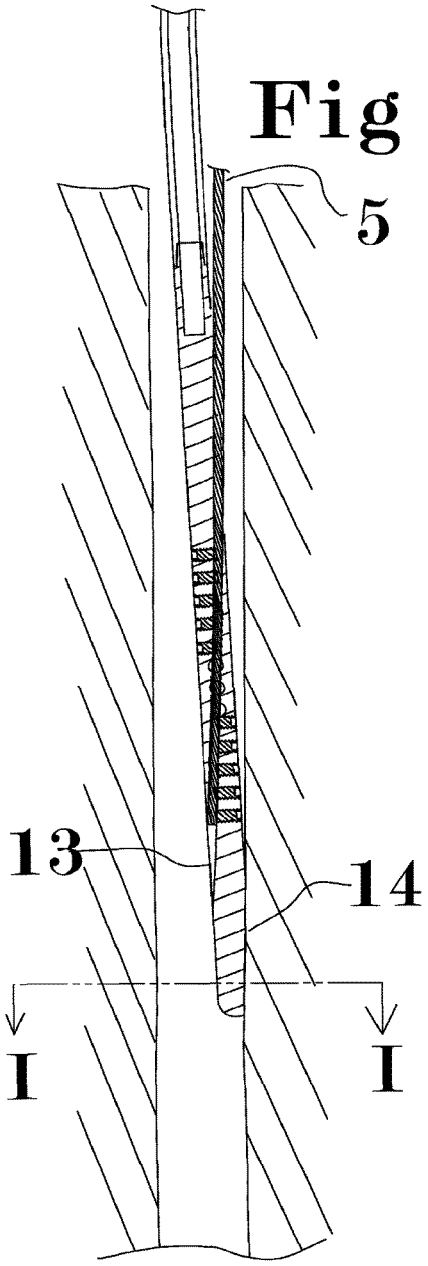
In FIG. 3 the end of the pipe has a special shoe 13, or "shoe" piece where the end of the cable 5, is attached by some suitable means. The cable tension tends to force the shoe against the side of the hole, to help prevent rotation. If the pipe rotates, the cable tension would have to increase so this tends to prevent rotation. The shoe may have a milled flat 14, that also helps it resist rotation. Rotation of the milled flat would cause the centerline of the pipe to move further away from the wall of the hole and cable tension is keeping the pipe pressed against the wall of the hole.

The cutting tool comprises a pipe with a wire rope attached near its tip as shown in FIG. 3. The configuration is similar to the bow of a violin providing a pulling force on the string in either direction of travel. In FIG. 1 the wire rope is continually tensioned from the surface by a winch or other suitable mechanism as the sections of pipe are lowered into the hole by the rig. At depth, the pipe is reciprocated in the hole and the tensioned wire rope saw cuts into the formation above the pipe. The tension also keeps the wire rope pressed against the inside radius of the hole so that it does not wrap around the pipe.

Cuttings from the rock may add to the abrasiveness of the wire rope and aid cutting. Excess cuttings fall downward to the original borehole. Drilling fluids pumped down the pipe circulate cuttings out of the hole. The wire rope and rock chip abrasion cut a pathway into the rock according to the friction and tension in the wire rope. The cutting force is applied by the tension of the wire rope around the curved path of the hole. The wire rope tensioning mechanism at the surface may be adjusted continually as the pipe is reciprocated up and down in the drilling rig or held constant by a suitable control system. The mechanism may be set to maintain a different tension on the up stroke compared to the down stroke of the pipe. The wire rope tension may also be controlled by automatic winch at the surface as in FIG. 11 or controlled by a down hole tool such as the hydraulic sleeve in FIG. 14 or the cable grab tool, FIG. 18 either of which are used in FIG. 12. The tensioning of the wire rope could also be accomplished by simply running the wire rope over a pulley at the top of the rig and hanging a weight from it or a multi-part line to reduce the weight. The pulley could also be mounted on the drill pipe or preferably the swivel or traveling block. A winch or hydraulic tensioning cylinder could also be mounted at this point moving up and down with the pipe.

The pipe may be a standard oil well drill pipe suitable for tensile and compressive loading. If coil tubing is used, it may be best to use synthetic composite types which can withstand more bending cycles. For discussion we will assume use of 4½" External Flush type drill pipe, though some well conditions may allow more common internal flush drill pipe. The wire rope cutting cable is preferably smaller than the pipe. Commercially available wire rope in sizes from ⅜ inch to 2 inch diameter is considered optimal with larger sizes required for longer cuts or cuts that span a greater total angle. Torque balanced wire rope may be useful to avoid twisting and kinking of the wire rope saw as tension is removed, but some twisting may be desirable to obtain uniform wear. While ordinary wire rope may be used for cutting soft formations such as coal, it may be desirable for the wire rope to be at least partially eccentric so that it can cut a path slightly wider than the thickness of the wire rope as is done with other mechanical saw blades. This minimizes the problem of the blade getting stuck if the formation has residual stress that tends to close the cut or if the cutting surface wears down. One way to do this is to make the wire rope with one strand larger than the rest so that it can cut a pathway wider than the average wire rope diameter. The unbalanced rope will tend to twist as it is tensioned. It is often desirable for the wire rope to twist back and forth for more even wear. If twisting is undesirable, the larger strand can be made to have the same elastic modulus as the smaller strands to maintain the torque balance, This may be achieved by making the core or the whole strand from a material with a different elastic modulus. The wire rope may be infused, filled or coated with soft plastic, poly polyurethane or rubber to better convey rock particles and help prevent rock particles getting deep inside the wire rope. Conventional diamond wire saw cable may also be used if available in suitable size and strength. Commercially available diamond wire rope is generally too small and weak for this application but could be custom made as described herein for use in hard rock such as is found in geothermal applications.

A mile long pipe has very little resistance to elastic rotation of one end relative to the other so relatively small forces can twist the pipe at one end with the other end held fixed. It is important to prevent rotation of the tip of the pipe relative to the wire rope cable while running into the hole. This is because having the cable wrap around the pipe will prevent proper cutting action. One means of preventing this rotation is to simply maintain cable tension from the surface winch to the tip of the pipe.

Figure 4:
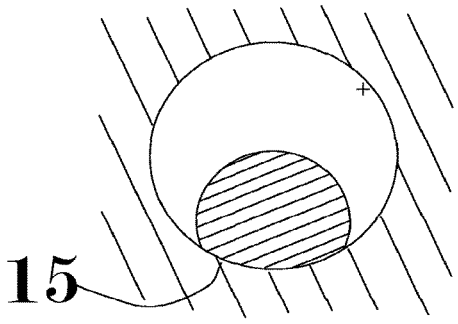
In FIG. 4, which is a section view, the milled flat has the same radius 15, as the hole.
Figure 5:
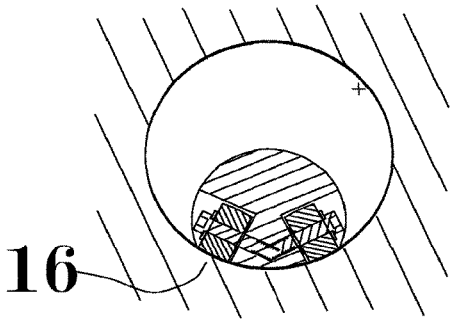
In FIG. 5, an alternate design section view, the milled flat comprises one or more roller wheels 16, within the body of the shoe to reduce friction and rotational forces.

Another possible means of resisting rotation is for the shoe piece of the pipe to have an angled "flat" milled to the radius of the borehole as shown in FIG. 3. This flat, shown in FIG. 4, is pressed against the wall of the hole by cable tension and helps the pipe resist rotation. A roller may also be installed in place of the flat to reduce friction as shown in FIG. 5. Cable tension is maintained from the time only a few sections of pipe are in the hole. Cable tension is increased as more sections of pipe are lowered into the hole. There will be some agreed upon maximum safe working load tension on the cable while workers are on the rig floor. Once enough pipe is in the hole, this safe tension will be maintained as the rest of the pipe is lowered into the hole.

Some well conditions may tend to increase the rotation potential. Normally an open pipe running into the hole is in tension in a vertical hole. However the cable tension will cause the lowest portion of the pipe to be loaded in compression for a short distance up to a neutral point where the weight of the pipe below exceeds the tension in the cable. The pipe from the neutral point to the bottom will be loaded in slight compression and will bend into a long curve potentially touching the walls of the hole at the top, middle and bottom points. For typical applications this portion of the pipe could be 200 to 1000 feet long. In long sections, compression forces may flex the pipe into a helical shape. Such a helical shape could impart rotational force as the pipe is lowered. If the drilled hole is not straight this could also impart rotational force to the pipe causing the cable to become twisted around the pipe. To avoid this problem a low friction swivel may be positioned between the shoe piece where the cable is attached and the rest of the pipe as shown in the top of FIG. 6. The swivel will allow the cable to remain straight even if the body of the pipe rotates. The swivel and other tools preferably have the same outside diameter as the pipe above it so that they will not become stuck in a key seat as the pipe is pulled through the hole. If key seat formation is not likely, the pipe may also be equipped with centralizer devices. Centralizers made with roller elements may be used since they also reduce friction in the horizontal hole.

Another way to prevent the pipe from rotating and encumbering the cable is to install an electronic sensing and rotational orienting device just behind the point where the cable is connected to the shoe of the pipe. This device would monitor rotation and optionally would automatically compensate for pipe rotation with a mechanism that rotates the section of the tool where the cable is attached.

If the cable should become stuck in the cut, such that it cannot be pulled out, the cable may be released from the end of the pipe so that the pipe may still be pulled out. A rubber wiper plug or a ball is pumped down the pipe and seals on a seat in a special release tool shown in FIG. 6. Pump pressure above a specified level will then move a spring or shear pins which cause the tool to release the cable. Any released parts of the tool are preferably retained so that they come out of the hole when the pipe is pulled back. Alternately the cable release could be accomplished with a simple shear pin device as in FIG. 3, that releases the cable at a specified tension or an electrically fired explosive that could release or sever the cable.

FIG. 6 shows an example of how a tool could be designed that incorporates a low friction down hole pipe swivel, a circulating port and a mechanism to retain the end of the cable while allowing it to be released by either extreme circulation rate pressure or by pumping a wiper plug down the pipe. The mechanism grasps the cable by placing it in a groove within a conical sleeve that is then squeezed by a mating conical mandrel as shown in FIG. 7 and cross section view FIG. 8. When activated by movement of an internal mechanism, the conical sections separate and the cable is released. Since the cable is plain end and has no enlarged section it may be readily extracted by pulling it through the cut. The circulation port may optionally remain active both before and after operating the release so that the circulation may continue as the pipe is pulled out of the hole. FIG. 9 shows an external view of the slot for the cable. FIG. 10 shows the cross section of the end of the tool having a flat that matches the radius of the hole.

This multi-function tool of FIG. 6 is potentially desirable to improve reliability of the process in certain conditions but some or all features may not be required when conditions are different or when other means such as electronic sensors are employed. It is obvious that the three functions of cable retention-release, circulation port, and pipe swivel could be served by separate tools and moreover it is possible to practice the invention without any or all of these three features as shown in FIG. 3. The design shown is one of many possible and is not intended to exclude other means. It will be obvious to those skilled in the art that the release of the cable could also be achieved by use of various means such as a mechanism that shears off the cable or by explosive shaped charges that sever the cable.

In practicing the technique, it may be useful to perform some reciprocation of the tool string around the first bend in the hole, to at least partially form the upward vertical cut here before taking the tools very far along the horizontal bore hole. This will tend to assure that the cable remains in the correct rotational orientation around the bottom 90 degree bend before the pipe is extended to the end of the hole.

If the pipe should twist while running into the hole and the cable wraps around the pipe the friction due to over 180 degrees of contact between the cable and the pipe would essentially prevent significant tensile load and thus elastic stretch of the cable beyond that point. The net cable stretch due to variable levels of cable tension at the surface may optionally be used to infer the distance along the hole that the cable extends without wrapping around the pipe. The total cable length still in the hole after cutting a slot compared to the total length after cutting the slot may be used to calculate the depth of the cut.

If the cable should break during operation it may be pulled out from the surface. The method of cable attachment may optionally be such that the cable may flex backward. As the pipe is pulled back any remaining length of cable will trail behind the pipe as the pipe is pulled out. The cable could be released by pumping the plug down to activate the cable release mechanism.

Semi-Horizontal Cuts

The Wire Rope Saw Tools may also be used to form non-vertical cuts in formation strata. In FIG. 2 the borehole descends to the target strata makes a 90 degree bend and then travels horizontally for some distance before turning back upward 45 degrees. This allows it to make a cut with greater surface area. However if, instead of turning upward it simply turns horizontally within the plane of the strata, the cut formed will also be horizontal at this end and transition to vertical back at the original bend from the vertical wellbore as in FIG. 11. Modulating the tension of the winch to a higher value on the down stroke may be used to cause the cut to advance more rapidly in the final bend to maximize the vertical height of the cut created within a relatively thin horizontal strata. This approach increases the surface area of the cut that can be placed within a within a relatively thin layer of strata. Multiple parallel laterals extending off the first horizontal borehole within the horizontal plane of the strata may be created to maximize recovery as in FIG. 11. FIG. 12 shows a single arc formed from a lateral off the vertical wellbore. To avoid subsidence, the cut may be a more uniform distance into the formation all along its length. The horizontal portion of the hole is preferably a long uniform arc instead of a long straight horizontal run with a bend at each end. A more uniform arc tends to let the cable cut a uniform distance from the original hole all along the borehole. Additional horizontal laterals may be formed within the same strata. This may form a shape similar to a pinwheel as shown in FIG. 13 to maximize the production from a rectangular lease area.

Normally subsidence overburden force would close a horizontal cut of large size, but due to the curving arc shape of these cuts they can be larger and yet remain open. A balancing pressure may be maintained with pressure at the surface or by hydrostatic pressure of the drilling fluid to keep the cuts open during the work. At least a portion of the cut may be allowed to subside and close after the cuts are complete. When the cuts are at least partially horizontal, removal of cuttings by fluid circulation is less efficient than for vertical cuts where gravity assists in moving cuttings to the original borehole so significant volumes of cuttings may be left in the cut to help keep it at least partially open. It may be more effective to use compressed air or foam in place of a conventional mud, or the compressed air may merely be used to sweep the fluid out after the cut is complete.

Another method of removing cuttings comprises using the end of the tubing as a swab within the original well bore to generate a back and forth flushing action in the cut. To facilitate this, the end of the tubing may include a tool that fits close with the well bore so that the stroking action of the tubing pipe causes fluid to move rapidly back and forth through the cut.

Controlling the Wire Rope Cutting Action

Figure 11:
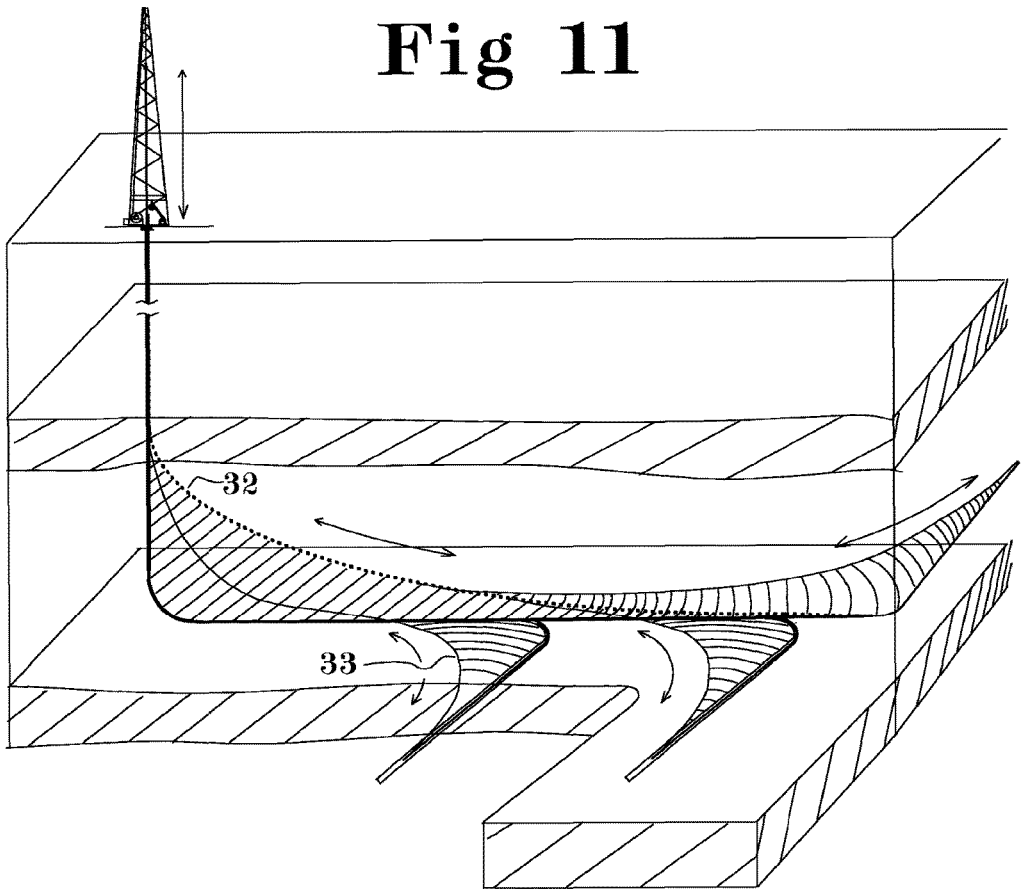
FIG. 11 shows a well with three laterals that branch off from one horizontal lateral. Each of the three laterals is cut separately and transitions from a vertical cut near the main bore 32, to a near horizontal cut at the ends 33.
Figure 12:
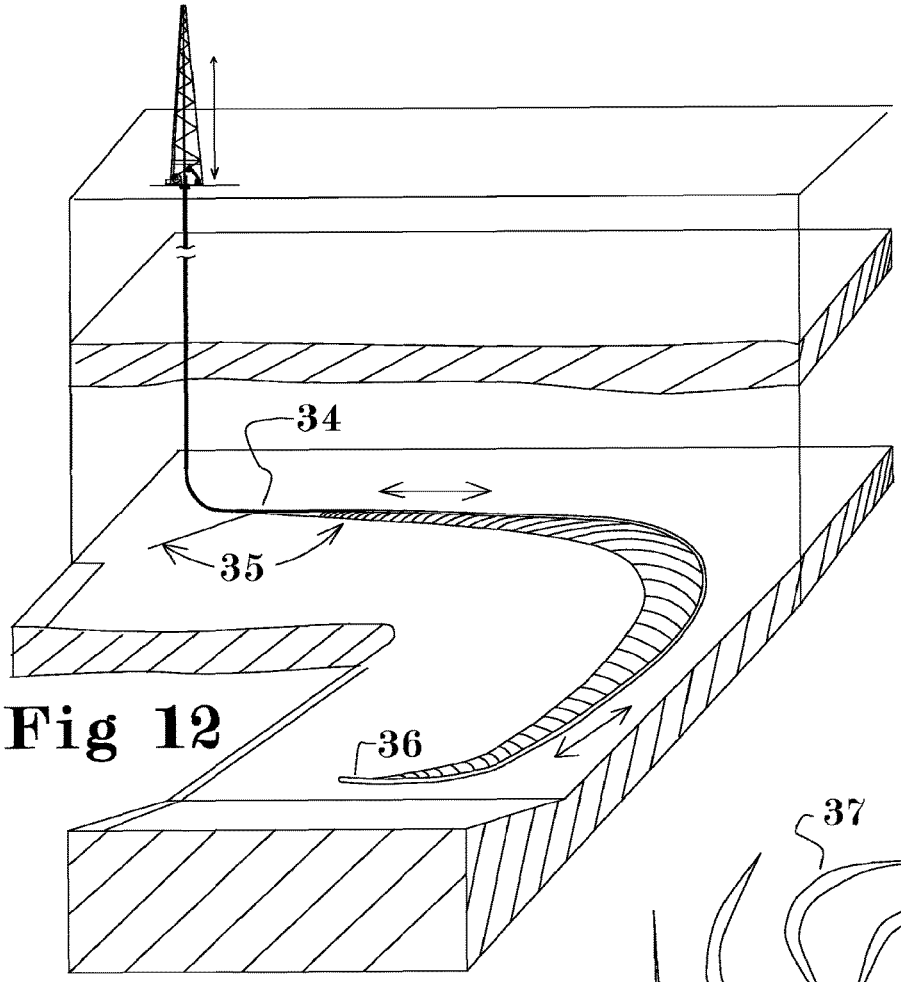
FIG. 12 shows a partially horizontal cut made using a down hole grab tool 34, to hold tension at a point below the initial right angle bend so that a greater total arc of contact may be cut within the thin production formation layer. The end of the hole turns up so that the cut will angle upward rather than being horizontal.
Figure 13:
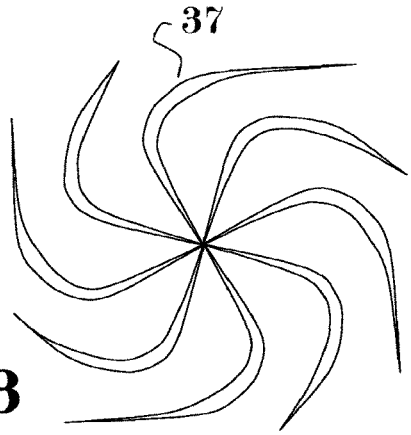
FIG. 13 shows a pinwheel type pattern 37, which could be developed with multiple kickoffs of laterals cut as in FIG. 12.

In the case of a very thin formation layer it may be desirable to make substantially all the formation cuts in a near horizontal orientation as in FIGS. 11, 12 and 13. In this case it may be undesirable to also form a cut along the initial right angle bend from the vertical hole. This is not only to avoid cutting into the upper formation the target zone but to reduce the friction of passing through the right angle bend. The simplest way to do this is to reduce the cable tension through the bend. There are many methods that reduce or eliminate the cutting within this initial right angle bend. One approach comprises installation of a casing pipe through the initial right angle bend that provides a significantly reduced coefficient of friction. Such a pipe may have an internal Teflon impregnated surface and may also benefit from the lubricity of the drilling fluid. Rollers may be also be installed inside the pipe in the area of the right angle bend. Short sections of pipe having internal rollers could be placed between each section of pipe. The cable could also be routed through a smaller tubing that has a low friction surface treatment. Alternatively the entire cable from below the right angle bend to the surface may optionally be replaced by a tubing pipe. This pipe could also have a low friction surface treatment such as Teflon coating. The cable itself could have a low friction coating or low friction beads attached in the area that will operate in the bend. By reducing the friction of the wire rope cable around the initial right angle bend more power is transmitted to the next bend. The coefficient of friction of wire rope cable against steel is less than 0.10 while the cable against the shale formation rock has a 0.7 to 1.2 coefficient of friction.

One approach to minimizing cutting action on the initial right angle bend is to reduce the cable tension through the bend. Wire rope extending from the surface sees its tension reduced at depth due to the weight of the cable. The tension in the cable can drop very low at a sharp bend. Instead of tensioning the wire rope from the surface, the wire rope may be tensioned by a mechanism on the drill pipe in the horizontal section of the hole, allowing the cable to be nearly slack around the right angle bend. One such mechanism could comprise a concentric hydraulic cylinder member around the pipe operated by internal pressure of the pipe as shown in FIG. 14. As the pipe circulation pressure rises, the tensile load on the wire rope cable trailing attachment point increases. The cable may extend back to the surface as in FIG. 2 or it may optionally terminate at the trailing attachment point.

Another means of tensioning the cable from a point below the first bend comprises a down hole tool fashioned such that it can grab the cable and hold tension between it and the end of the pipe while the winch on the rig releases tension. This tool could be located past the initial right angle bend. The cable will then cut in only along the inside of the curve of the hole from that point onward. This will allow a greater total contact angle than would be possible with the first bend also included. The contact angle can be in a vertical plane, partially horizontal or even a partial helix or spiral. This grab tool could be operated by internal differential pressure present on the pipe when circulating drilling fluid. After the winch tensions the cable, circulation pressure is applied and the tool grabs the cable. The winch may then release its tension and the grip mechanism grips tighter as the cable tries to pull back. Such a tool could be designed as shown in FIGS. 15, 16, 17 and 18. FIG. 15 shows a radial cross section of the gripping mechanism. FIG. 16 shows a longitudinal cross section of the tool. FIG. 17 shows an external face view of the hinged cover.

FIG. 18 shows an external side view of the tool with a cable passing through the gripping mechanism. The wire rope cable may be positioned in a longitudinal recess along the tool and then secured with hinged cap assembly that covers the cable. A rubber sleeve inside the tool transmits pressure without allowing debris to enter. The cable may normally slide freely through the longitudinal recess. However when the tool is activated by circulating drilling fluid, this pressurizes the interior of the pipe relative to the external pressure. The cable is pressed between two tapered die halves and gripped so that it cannot slide through. The parts contacting the cable may be removable die halves contoured to the cable shape having a tapered exterior which moves within a similarly tapered cavity to push the die halves closer together as the cable moves in the gripping direction against the spring. Spring force may bias at least one of the die halves to release its grip when the internal pipe pressure is released and tension is applied from the winch.

As the tool string is run into the hole with the cable attached to the shoe piece such as FIG. 3 or FIG. 6, the winch maintains a depth specific tension on the cable. When the grab tool is installed in the rig, the cable is pressed into the longitudinal recess in the tool and the hinged cover is closed and bolted shut. The cable can move freely through the tool as long as circulation pump pressure is very low. Once the tool is lowered past the initial right angle bend, the cable extending through the tool to the surface may be tensioned to the full working tension by the winch. The tool is then activated by internal pressure due to pump pressure circulating the drilling fluid. This causes the cable to be gripped and then the winch tension may be released. The length of cable wound back off the winch as tension is released can be used to calculate the length of cable that has relaxed and thus verify proper operation of the tool. The gripping tool can then independently maintain the tension from that point to the distal end of the hole while the winch is free to release enough tension to allow the cable to be relatively slack through the initial right angle bend.

A grab tool could alternately be operated by an electrical signal, or by a J-Slot mechanism responding to repeated cycles of tension on either the drill pipe or the cable itself. For example every third time the cable is tensioned beyond a certain level the mechanism would cycle and lock in the tension.

Controlling the cutting process generally requires that the operator have some control of the tension on both ends of the cable. The trailing end of the cable can be tensioned by extending the cable to a device at the surface or by a suitable down hole tensioning system as described above. Control of the cable tension on the leading end of the pipe is based on the weight of the pipe pulling the cable forward into the hole. The various mechanisms of cable tensioning may be used together or separately.

Discussion of Alternative Means of Implementing the Method

While a downward wire rope saw cut is possible it requires drilling a hole with greater total curvature which increases friction. One way to do this is with the grab tool of FIGS. 15, 17, 17 and 18 or with the tensioning tool of FIG. 14. This allows the cable to be tensioned only within the desired portion of the hole. Removal of the cuttings may become much more difficult in a downward cutting approach since they tend to fall downward.

The above wire rope based cutting tools are designed to cut along a long curved hole but sometimes it may be useful to cut downward from a relatively straight horizontal hole. An example of this is a workover of an existing well whose production has declined. These wells typically go down to depth and then turn 90 degrees and travel horizontally as in FIG. 1. The method would be applied by running a slot drilling string into the old well and cutting downward from the existing horizontal portion of the hole to form a wide slot. It may also be desirable to form a wide cut that can be more easily packed with proppant to act as a gathering gallery in a formation that produces a lot of sand.

The alternative implementations of the method utilize different tools for cutting downward. These tools still utilize the energy of the drilling rig to cut the slot but obtain force against the side of the hole by gravity alone. These tools cuts a wider pathway and are driven against the rock face by gravity rather than tension around a curve, so they can cut downward from a straight horizontal hole. One version of the tool shown in FIG. 19 uses reciprocation and cuts with mechanical teeth and/or high pressure jets of fluid. The other version shown in FIG. 29 also uses mechanical teeth and but utilizes pipe rotation to perform the cutting and adds helical flights to help remove cuttings from the hole. The cut is roughly as wide as the borehole so it is expected to be better able to resist closing up due to relaxation of residual formation stress compared to the cuts formed by a wire rope saw.

Reciprocating Heavy Pipe Tools

Figure 19:
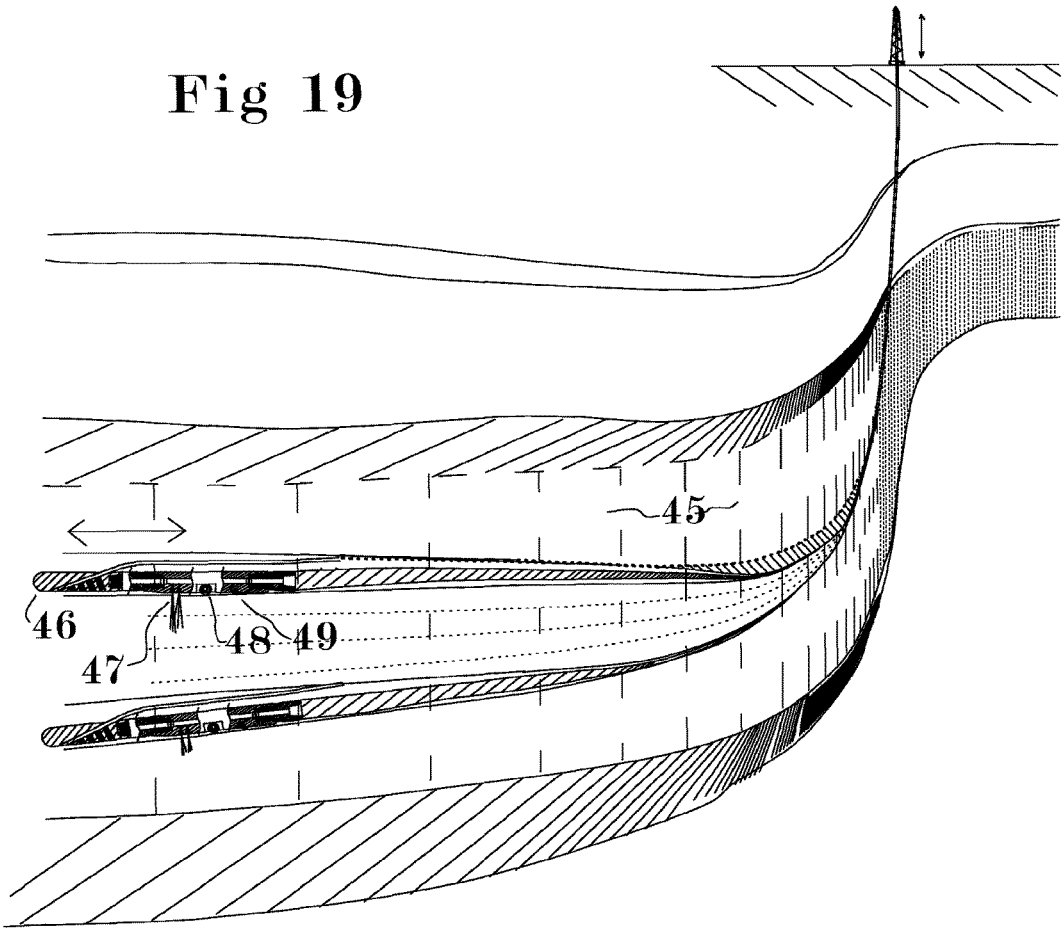
FIG. 19 shows the reciprocating pipe tool running in a long horizontal hole within a thin shale formation 45, and cutting downward to the form a wide slot. The shoe piece 46, is attached to the cable extending back to the surface, which helps the tool remain properly oriented. The tool tools cutting means comprise jets 47, rolling cutter wheels 48, and rock picks 49.
Figure 20:
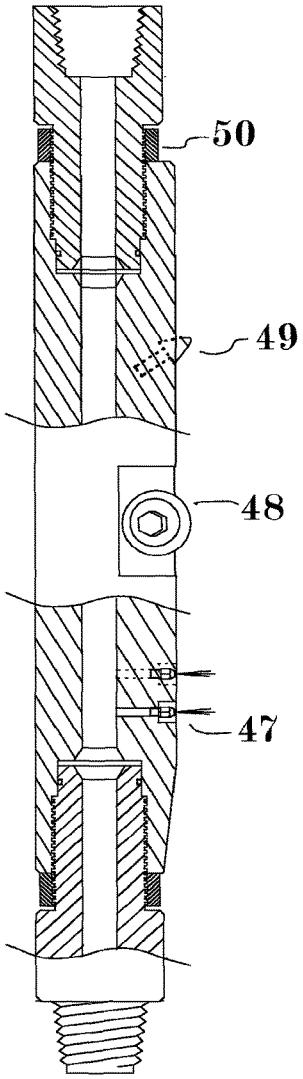
FIG. 20 shows the reciprocating pipe tool cutter section with the jets 47, rolling cutter wheels 48, and rock picks 49. The tool also includes jam nuts 50, to rotationally align the tool.
Figure 21:
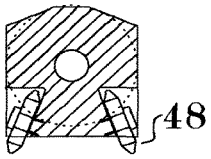
FIG. 21 shows a cross section of the rolling cutter wheels 48.
Figure 22:
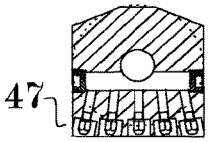
FIG. 22 shows the cross section of the jets 47.
Figure 24:
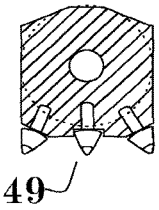
FIG. 24 shows a cross section of the conical picks 49.

FIG. 19 shows a Reciprocating Heavy Pipe Tool operating in a deep horizontal lateral within a thin production formation. The Reciprocating Heavy Pipe implementation of the method uses a wire rope cable attached to a very heavy pipe that reciprocates much like the Wire Rope Saw tool previous described above. However, in addition to the upward cutting action of the cable, the heavy pipe forces the cutting implements on the lower side of the pipe to cut into the formation. Rock chips are flushed out of the hole by circulation of drilling fluid. The ends of the tool may be able to be rotationally adjusted to compensate for random drill pipe make up positions as in FIG. 20. In a special implementation shown in FIG. 22, nozzles on the lower side of the tool eject fluid at high pressure between 1,000 psi and 10,000 psi relative to ambient hydrostatic pressure to augment the cutting action of the mechanical cutting means. The mechanical cutters may be conical picks as FIG. 24 or may be rolling disk type cutters as in FIG. 21. Rolling disk cutters are similar to those used for tunnel boring machines and are expected to be more efficient at breaking up rock. The chips of rock may be further dislodged and broken up by the jets.

Figure 23:
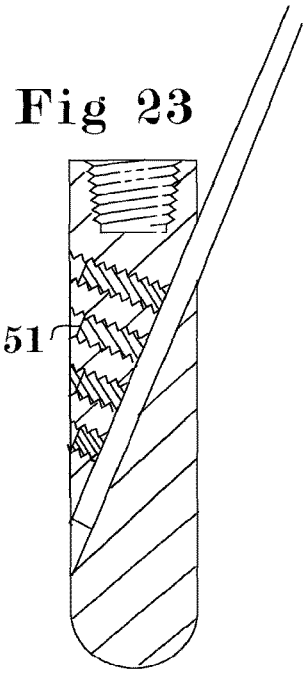
FIG. 23 shows the cable attachment shoe with anchor bolts 51.

The Reciprocating Heavy Pipe tool may be run with a wire rope cable attached to the shoe piece as in FIG. 23, and tensioned by a winch on the surface as in the Wire Rope Tool described above. Operating a mechanical or jetting tool in a pure reciprocating fashion requires being able to correctly orient the tool so that it may cut downward because only then does it benefit from gravity forcing the cutting means against the rock face. Without this downward force the cutting action would stop. The tool may be designed as in as in FIG. 20 as a modular pipe section which can be inserted at 90 foot intervals along an ordinary drill pipe so that the rig stroke can cover the length of the entire horizontal hole. The attached wire rope cable tensioned from the shoe of the tool to a tensioning device at the surface causes the tool to bend slightly with the cable on the top of the tool taking the shortest path through the curved path of the wellbore. The wire rope cable serves to orient the gravity driven portion of the tool while optionally forming an upward cutting member to cut an upward path as in the pure wire rope tool above. The cable does not have to extend all the way back to the surface but only through the right angel bend to maintain orientation of the cutting elements.

The tool section portion of the pipe having the cutting means may be eccentric to the radius of the drill collars and extend below the radius of the drill collars so that their weight bears on the cutting means. There may be multiple cutting means along the pipe. Standard drill pipe threads do not rotationally align adjacent sections so a rotational adjustment mechanism such as a thread and jam nut, shown in FIG. 20, may be added to each end of the piece having the cutting means. Each tool section containing a cutting means may be separated by regular drill collars so that the each cutting means is separated by a length approximately equal to but preferably shorter than the stroke of the drill rig.

This Reciprocating Heavy Pipe tool has a similar appearance to the cable saw tools described above with a cable along its length attached to a shoe tool on the end of a drill pipe, but its cutting action relies more on gravity rather than hole curvature. The rolling cutters form much larger rock chips than the cable saw and these rock chips may tend to stack up in the slot rather than being circulated to the surface as the slot depth increases. The fluid in hole and the fluid being forced through the jets may be designed with gelling and solids suspending properties that help these chips slide past one another and help prevent them from wedging the pipe in place as it reciprocates in the hole. The fluid could be designed like a fracturing gel with an internal chemical or biological "breaker" to revert to a water-like liquid after slot drilling is complete. The larger rock chips then help prop the slot open. The slot drilling string may become stuck in the hole at the end of the cutting and may simply be left in place and perforated as a production pipe. The upper portion may be perforated and cemented in place.

Generally the pipe must be quite heavy to generate the needed downward force so this means that a larger diameter pipe such as drill collars will be needed and this will generate a wider cut perhaps 6 to 12 inches wide. After the downward cut extends several feet, the circulation flow rate through the extended slot may be insufficient to transport the cuttings out of the slot even with a viscous drilling mud. To help transport the cuttings the position of the jet nozzles may be oriented so that they assist in pushing cuttings back to the un-enlarged portion of the hole. Mechanical wipers made of rubber or steel may also be added to help pull cuttings back with each stroke of the pipe. As in the wire rope saw above the pipe would be stroked by raising and lowering the pipe in the rig. This may be a distance of about 90 feet, depending on rig type. The wipers are suitably designed to slide back over cuttings on the downward stroke but on the upward stroke they pull cuttings back toward the un-enlarged well bore where fluid circulation can transport them up out of the well.

Figure 25:
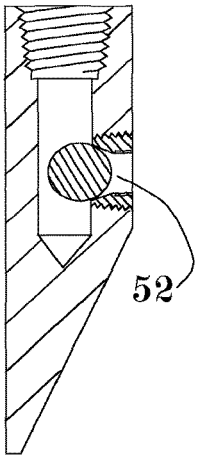
FIG. 25 shows an alternate design for the shoe that uses a gravity reference ball valve 52, to orient the tool instead of the cable.

If special orienting tools, such as those previously described, are utilized in the Reciprocating Pipe Tool, the wire rope cable will not be required to orient the tool. Such a tool would only cut downward. Such orienting tools may include electronic orienting tools that report the position of the tool to the operator. The tools may also be oriented by a gravity reference mechanical system that allows circulation flow only when the tool is in the correct rotational orientation, with the cutting means down. An alternative mechanical method is shown in FIG. 25 in which as ball is kept on its seat by gravity only when oriented one way. This could allow the operator to circulate drilling fluid only when the tool was in the correct rotational orientation in the horizontal bore hole.

Rotary Pipe Tools

Another approach to orienting the cutters of a tool is to add cutters all around the circumference of a heavy rotating pipe so that it can cut downward regardless of rotational orientation. This type of tool also relies on gravity to keep it pressed against the rock to be cut. By rotating the pipe as well as reciprocating the pipe the tool can also take advantage of the rotational power of the rig. Most rigs have 25,000 to 100,000 foot pound of torque available to rotate the pipe. The Rotary cutting tool is a very heavy walled pipe such as a drill collar with rock cutting means such as teeth or cutters on its exterior such as in FIGS. 26 and 27. This type of tool is rotated and reciprocated within the borehole to form vertical trench from the original horizontal portion of the wellbore downward through the formation. The Rotary Pipe Tool can operate in a true horizontal hole rather than cutting a long arc as the wire rope saw does so it is useful for making a cut in a relatively thin layer of strata or reworking an existing and substantially straight horizontal lateral well.

Figure 26:
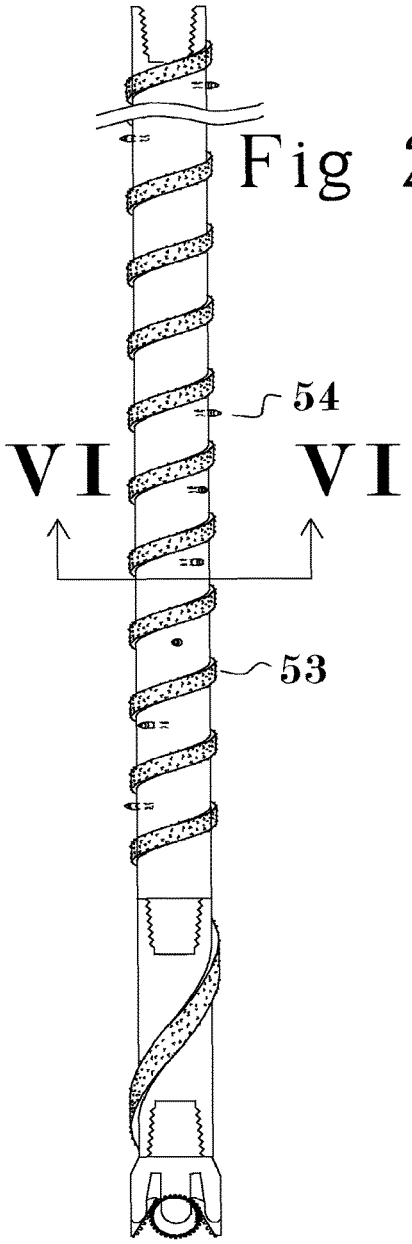
FIG. 26 shows a rotating pipe tool with helical ridges 53, and rock picks 54.
Figure 27:
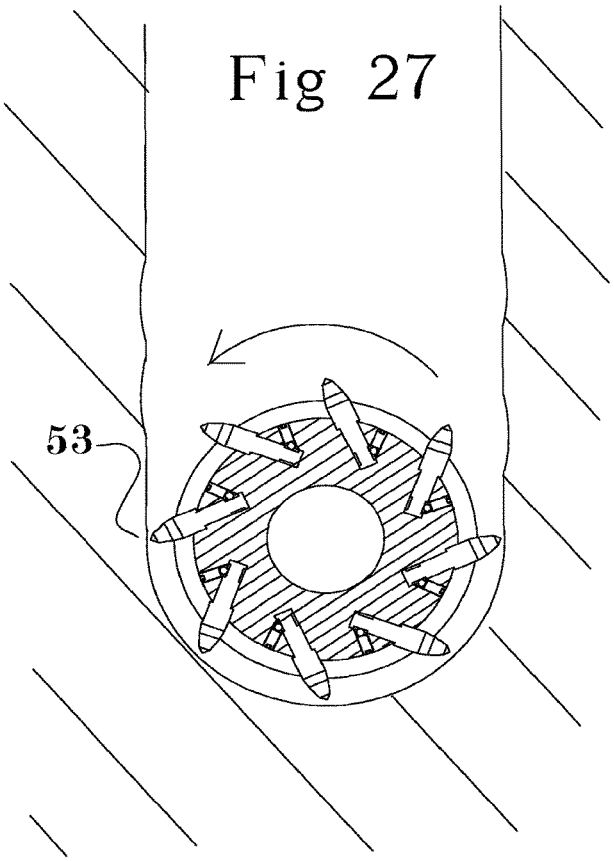
FIG. 27 shows a cross section of a rotating pipe tool with rock picks in all positions.

The rock cutting teeth may be arranged helically around the pipe as in FIG. 26 or grouped at intervals along the pipe as in FIG. 27. Drilling fluid would be circulated as in the other methods to remove heat and cuttings. Optionally, the drilling fluid may be delivered at high pressure to deliver additional kinetic energy to help break up the rock. Instead of the wipers of the pure reciprocating tool above, helical grooves may be cut into the body of the pipe as in commercial drill collars or an auger flight may be fixed on the outside of the pipe to help convey cuttings back along the length of the tool toward the surface as the tool is rotated.

Figure 29:
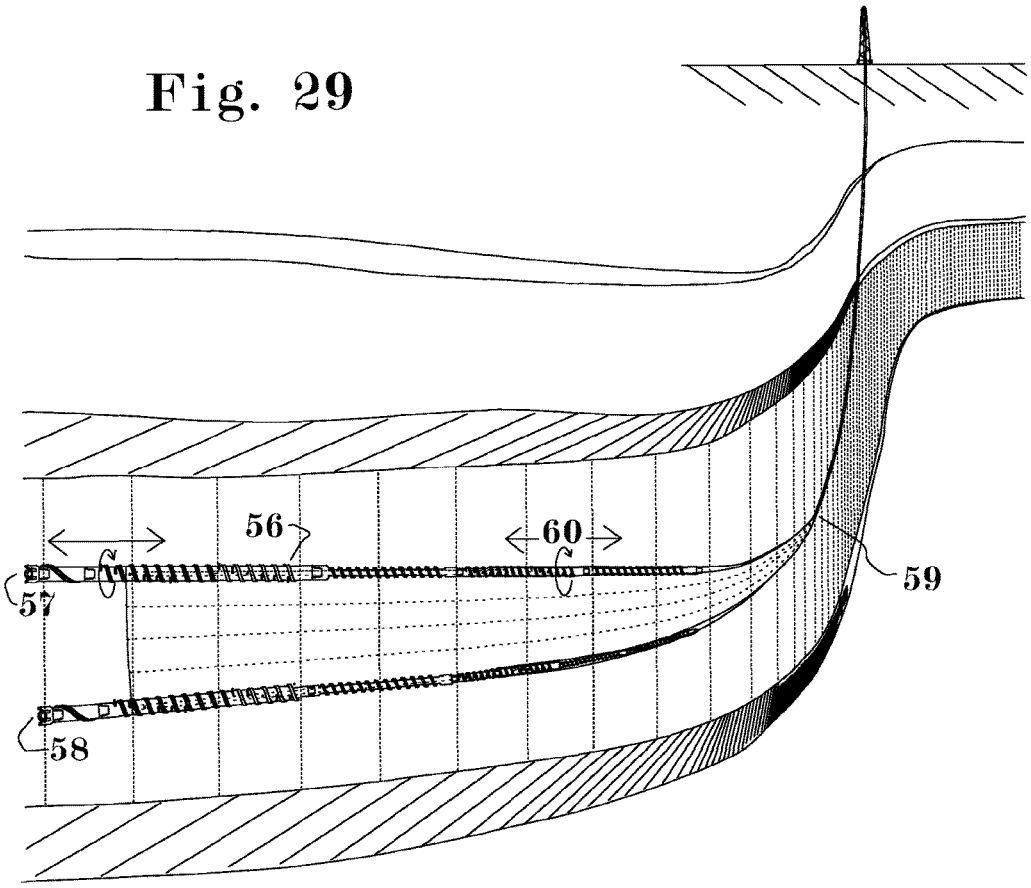
FIG. 29 shows the rotating pipe tool 56, operating in a long horizontal bore hole. As the tool cuts, it drops from its initial position 57, to progressively lower positions 58. Cuttings are transported by the auger flights back to the un-enlarged portion of the hole 59 where they are swept out by fluid circulation. The tool is rotated and reciprocated through the stroke of the rig 60.

The Rotary Pipe Tool would be inserted into the hole to the end of the horizontal bore or a horizontal lateral off the main bore hole as in FIG. 29. The tool would be rotated either by rotating the entire drill string or by means of a down hole mud motor. Drilling fluid such as water or drilling mud would be circulated down the drill pipe to ports positioned to help flush rock cuttings back to the surface. The ports may optionally be configured as jet nozzles to augment the cutting action of the mechanical cutting means. As the tool is rotated, the cutting teeth cut into the bottom of the horizontal borehole and the drilling fluid flow and the helical flights help carry the cuttings back along the drill string.

The cutting tool and adjacent pipe are made with a sufficiently thick wall and diameter that its weight provides enough downward force to allow the teeth to bite into the rock formation as it is rotated. Larger diameter pipe provides greater weight per foot of length. Since it must have a high net weight it will be at least 5 inches in diameter and will work better at a size of 10 inches in diameter, however larger diameters require more energy to operate. The cutting elements are preferably in modular sections, and with a sufficiently powerful mud motor, or rotary mechanism on the drilling rig the cutter sections could extend for 2000 feet or more. The tool may be reciprocated back and forth through the rigs normal stroke while rotating as shown in FIG. 29. Most rigs can lift or lower 90 foot sections of pipe, known as triples. A conventional electronic steering tool may provide data on the depth of the cut from the original borehole.

The teeth on the rotating tool may be replaceable rock picks, such as conical drag bits with tungsten carbide insert points such as the Kennametal U40HD, or commonly used in rock mining equipment as shown in FIG. 27. These teeth work by crushing the rock locally with a point load. The cutting teeth are pressed into the face of the rock by the weight of the pipe lying in the horizontal portion of the well bore. The pipe is sufficiently stiff to allow the weight of a substantial length of the pipe to bear on the cutting teeth. However the pipe is sufficiently flexible that it can elastically bend along the drilled borehole. The cutting teeth may be widely spaced so that each tooth has sufficient pipe weight to cut the rock efficiently. For example, with a net downward force of 1000 pounds on the pipe, a 5,000 psi rock may be crushed with a point that has a cross section less than ⅕ of a square inch. It will be appreciated by those skilled in the art of designing rock drilling equipment that the optimal design, size and spacing of such cutting teeth will take on many different forms. If the rotating tool is slowly reciprocated longitudinally as it is rotated it will form a series of cross-hatched cuts on the bottom of the main cut. These cuts will be further abraded by the motion of the auger flights dragging cuttings across them.

The teeth may optionally be arranged to allow the inertia of the heavy side cutting tool to increase the kinetic energy impact force on the cutting teeth. For example Kennametal brand style rock picks positioned between 90 degrees and 360 degrees apart would exert an upward force on the tool as they contact the bottom of the trench that lifts the tool off the bottom. As the tool rotates past the point of contact for the rock picks, the tool will begin to fall back toward the bottom of the trench so that the next rock picks strike the bottom of the trench with the kinetic energy of the falling tool. The rotation rate of the tool may be adjusted to maximize this effect.

As the trench becomes deeper, some of the cuttings formed by the teeth may be too large to be readily circulated out of the well by fluid flow alone. To help bring these larger cuttings to the surface the tool will have at least one external helical ridge which acts as an auger flight to push cuttings back toward the surface. The helical ridge as shown in FIG. 26 is preferably of a slightly smaller diameter than the cutter teeth so that it does not reduce the weight bearing on the cutter teeth. This ridge is preferably made with hard surface material to resist wear and help grind up the cuttings. In softer formations this ridge may perform at least some of the cutting work. The helical ridge may be formed in any suitable manner. It could be made by winding a steel strip helically around a heavy drill collar, welding it to the outer surface of the drill collar, and coating it with weld rod applied hard facing. The steel strips may be preformed to (180 degree or less) sections and welded onto the drill collar. A helical flight shape may also be formed by machining one or more helical grooves into the surface of the drill collar.

The Kennemetal style rock picks may be angled forward in the direction of rotation as in FIG. 27, to engage the rock face closer to tangent to the rotation of the tips. At least a portion of the cutter teeth could even be of a hooked eagle beak style that will bite into the rock by rotational inertia even with limited weight.

At least a portion of the cutters could be replaced with rolling cutter wheels such as those used on tunnel boring machines. The wheels apply concentrated load to cause local breaking and spalling of the rock surface. In conventional drilling, the weight of the entire drill pipe bears on the drill bit cutters. In the present application only the weight of the pipe relatively near the cutters is transferred to the cutter teeth within the horizontal portion of the hole. This greatly limits the force that can be applied to cutter wheels. It may be possible to generate a similar rolling contact effect by placing an axially rotating cutting disk on the end of the rock picks in place of the standard point. The goal is for the sharp edge of the rolling contact point to fracture the rock in tension, thus reducing the energy requirement to break the rock.

FIG. 26 shows a rotary cutting tool made from a heavy drill collar above a conventional tri-cone rotary drill bit. The drill collar is modified with a helical band covered with abrasive hard facing material. Rock picks are mounted in drilled holes along the tool in a helical pattern. The main illustration of FIG. 26 shows only one rock pick at each position along the length of the tool, but there could be many picks at each position as shown in the cross section view of FIG. 27. The picks fit into recessed holes and are secured with a set screw and ball bearing or other means so that they are free to rotate around their own centerline.

Figure 28:
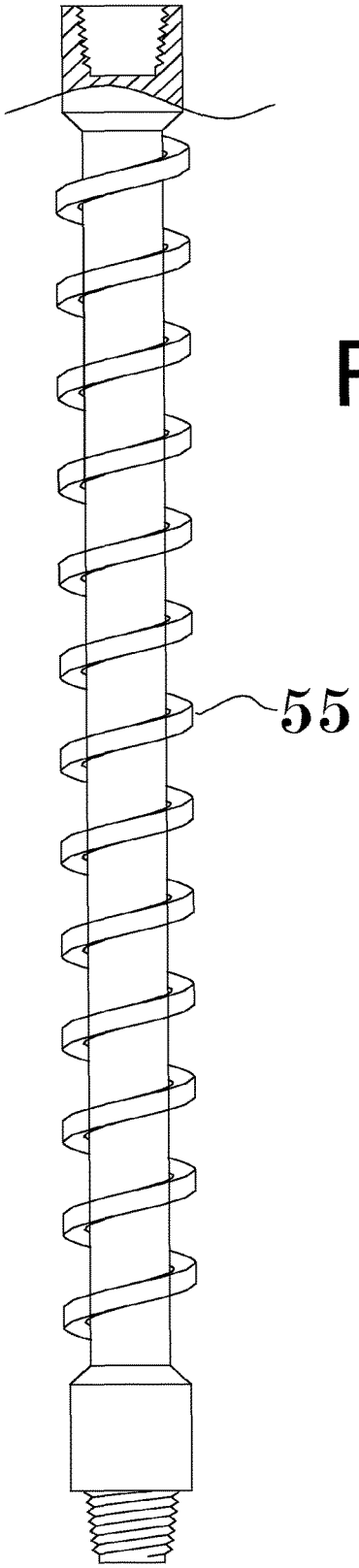
FIG. 28 shows a section of drill pipe that has been modified with an auger flight 55, or helical spring to help transport cuttings from the rotating pipe tool.

FIG. 29 shows a drill rig on the surface which has drilled a hole that turns horizontal at a targeted depth and runs horizontally through a specific formation strata. A string of the special tools from FIGS. 26 and 28 are shown running to the end of the horizontally drilled hole. The tool string is being rotated and reciprocated to cut vertically downward from the original hole to form a deep vertical cut. The tool string may consist of contiguous rotary tools made of the modified drill collars of FIG. 26, or it may alternate with one or more sections of regular drill pipe between each rotary tool. The regular drill pipe between tools may optionally be modified with at least partial helical auger flights to help transport cuttings as the pipe is rotated as shown in FIG. 27. Use of the sections of regular drill pipe increase the flexibility of the drill string.

Once the vertical cut, or "slot" is many times as deep as the original hole diameter, fluid circulation will be too slow to bring the cuttings out of the hole efficiently. The rotary tool and drill pipe sections would typically be 90 feet long and stroked through the typical 90 foot vertical travel of the rig. The auger flights will carry the cuttings back to a point where no vertical cut is being formed. The fluid circulated from the drill string will then carry the cuttings up the un-enlarged hole to the surface.

There are many possible tool configurations and operational modes. For example though the Rotary Pipe Tool described above is designed to rotate it can also cut a slot by reciprocation alone, just as the other implementation of the method. In some cases the total length of the cutting tool is only a fraction of the length of the horizontal section. When the distal end of the tool reaches the desired full cutting depth, the trench cross section side view profile will be somewhat triangular with the free end of the tool at the deepest point and the other end substantially within the original bore hole. At this point the rig operator may begin to gradually pull the tool back, continuing to extend the angled cut of the trench. This pullback may be one joint at a time or in continuous fashion if the rig has the capability.

Monitoring the Cutting of the Slot

The rock cuttings will be circulated to the surface along with the drilling fluid and a portion of the solids will be removed by hydro cyclones and shale shaker as is known in the art. The volume of these cuttings removed will indicate the total volume of slot formed and allow us to calculate the net surface area increase due to the treatment based on the size of the cable saw or cutting tools being used. For the tools which use a cutting cable the dimensions of the cut may be estimated by monitoring the length of the cable retracted back to the winch.

Fracturing a Mechanically Cut Slot

Regardless of the tools used or the width of the cut of a slot, the planar shape of the slot provides the opportunity to further increase production by a special form of fracturing technology. The physical size and shape of a slot will cause it to respond to fracturing in a very different manner than the response of a tubular drilled borehole. The slot or cut is essentially a very large planar surface. Even a small pressure applied to such a large planar surface will generate very large displacement forces. For example a 100 foot tall by 2000 foot long vertical slot with a net pressure of 150 pounds per square inch will experience a force of over 4 billion pounds of force. At 10,000 psi, explosive fracturing pressure it will experience 144 million tons of force trying to widen the slot. The means described herein are only applicable to large planar slots and as such they represent part of the inventive step, which cannot be employed in the absence of a substantial planar cut or slot. A substantially vertical slot 100 feet high and 2000 feet long may cross thousands of natural fractures. Opening up sealed fractures and widening and extending natural open fractures is intended as a natural part of the slot cutting method and therefore part of the subject patent application.

Once a substantial planar cut has been formed it may be useful to employ fracturing to extend the cut from its edges or to opening existing fractures crossed by the slot. In the case of the pinwheel shaped horizontal fractures in FIG. 18 this can at least partially connect the arms of the pinwheel structure to form a very large drainage field within a very thin vertical formation without breaking into the adjacent formation above or below it. This may be done by simply pumping water as is known in the art or it may be done with pressurized gas, combustive, explosive, or propellant based fracturing methods.

Hydraulic fracturing generally conveys equal fluid pressure to all areas with a relatively slow pressure rise rate. Propellant and explosive methods allow much faster pressure increase rates which can result in significant pressure differentials as the pressure wave travels at subsonic or even supersonic speeds. The pressure rise in a very large planar cut also tends to compress the formation in a direction perpendicular to the plane of the cut changing the local fracture gradient. Fractures forming at the edge of the plane will allow pressure to bleed off but with a sufficiently fast pressure rise time fractures will occur in many places at once. If the pressure within the cut is raised sufficiently rapidly it is possible to create multiple fractures perpendicular to the plane of the cut by inertial confinement. Essentially this means that in a large planar cut, the pressure rises above the fracture pressure at the middle of the plane before the edges of the plane are exposed to the much smaller pressure needed to fracture at the edges of the cut.

If at least two substantially parallel slots are cut, and one is exposed to rapidly building fluid or gas pressure it may result in displacement and or fracturing of the rock between the two slots. This may liberate large quantities of gas from the rock into the slots extending from the wells.

One method of generating the rapid pressure rise is to create an explosion or deflagration using the natural gas produced by the formation. The tubing pipe may be used to circulate air into the cut to achieve a combustible mixture at the temperature and pressure conditions in the target formation. The relatively higher density of the air compared to the natural gas may be used to displace gas from the lower areas within the target formation. After air is placed within the formation the well may optionally be sealed shut and the pressure allowed to rise to the point that combustion is optimized. The tubing may also be used to set a temporary plug in the vertical well bore and to deliver an ignition means to the combustible gas mixture. Entrained dust within the air may be optionally used to serve as a micro proppant to keep fractures from closing completely or increase erosion as the gas flows into the formation cracks. Combustible dust such as coal dust may be introduced with the air to augment the explosive character of the mixture of air and natural gas. Small amounts of other promoting chemicals such as nitrous oxide, propane, acetylene, hydrogen, hydrogen peroxide, or oxygen may be added to the air to accelerate the propagation of the flame front. Flame retarding chemicals such as chlorofluorocarbons may be added to slow down combustion. Liquid/liquid mixtures of fuel and oxidizer or foam made with one liquid and one gaseous agent may also be used.

Explosives such as solid rocket propellant are typically a mixture of ammonium perchlorate and aluminum powder in a synthetic rubber base. Such materials may be made in a fluid consistency which solidify to a solid may be cast into the slot with an ignition device along at least a portion of the slot centerline. The rubbery material seals against the sides of the slot and can be used to create a high pressure zone in the central areas of the slot to facilitate fractures extending normal to the plane of the slot before pressure reaches the edges of the slot.

The pressure generating process preferably creates a combustion deflagration or explosion at depth that does not extend back to the surface. Optionally a plug in the wellbore that is covered by a column of fluid provides inertial and thermal damping to discourage the flame front from proceeding up the primary wellbore to the surface. Use of in-situ natural gas and air to fracture the well reduces the environmental risk of hydraulic fracturing with chemicals as well as eliminating the requirement of huge quantities of water and disposal of contaminated water that returns to the well after hydro fracture injection.

Another useful method of rapidly generating the high pressure needed to fracture a formation is to employ a combustion based gas generating system on the surface or below the surface in the pipe. One type of gas generating system can be fabricated from a heavy pipe filled with paraffin wax and having a hole down its centerline. Optionally the existing cemented-in-place well pipe may be internally coated with paraffin wax. An oxidizer such as nitrous oxide, oxygen, or air is injected through the hole at a velocity sufficient to produce turbulent flow. An ignition means such as a small solid fuel rocket motor ignites the resulting flow. The combustion rate of paraffin which is normally quite slow will be increased dramatically resulting in a very rapid production of hot gasses. These hot gasses will enter the formation slot and cause fracturing to occur. The actual speed of gas production may be modulated by varying the flow rate of the oxidizer. For example the flow might begin slowly until the gas in the cut reaches a significant fraction of fracture pressure and then rise very rapidly to encourage multiple simultaneous fractures in the planar area of the cut.

The paraffin wax compounds include at least a portion of higher melt point wax such as microcrystalline branched chain waxes. Low grade non-purified branched chain wax that has a very dark color may be selected for its low cost and higher strength. Such wax is sometimes known as crude petrolatum. The wax may also be filled with powdered additives such as carbon black to modify its mechanical properties and the flow properties of the liquefied wax. The wax may also be filled with powdered oxidizer materials such as calcium hypochlorite or sodium hypochlorite compounds to accelerate burning as well as modify the physical properties of the wax.

Well Completion

In conventional prior art practice, a surface casing is cemented in place to below the water zones and then a smaller drill bit drills to the depth of the shale and turns horizontal. After the horizontal section is drilled it is cased and cemented. Then the casing is perforated and fractured at intervals along the horizontal segment.

In the present method the vertical cut may be formed before the casing is emplaced in the horizontal well or afterward. In unstable formations it is better to install a fiberglass casing cemented in place in the well before beginning to cut the slot. The well may optionally have a slotted casing installed after the vertical cut is made. In unconsolidated formations the portion of the well below the vertical part of the well could optionally be cased with a material that may be cut by the abrasive cable such as plastic or fiberglass, or a formed in place liner material, or a hardening sleeve inverted into the wellbore as is known in sewer line rehabilitation. The slot could then be cut through this material.

Before or after the cuts through the producing formation are complete, the upper portion of the well may be cased and cemented. For gas production, generally the fluid must also be removed from the well. The surface casing and casing down to the target formation may be installed before or after the cut is made. The casing may be installed before drilling the well to final depth and turning the drill horizontally. In this case the casing is cemented in the conventional manner and the cementing tools drilled out as the hole proceeds to depth. In the casing is being installed after the cut is complete, a balanced plug cementing technique may be used to cement the casing without getting any cement below the casing. A casing packer with multiple stage cementing tool may also be used to cement behind the casing.

Additional Implementations of the Method

In addition to uses of an abrasive cable around a bend in the hole there is another way to generate drilling force normal to the borehole. A drilling assembly with auger flights as shown in FIG. 26, FIG. 27, and FIG. 28 will exert tensile pulling force on the drill string behind it. If the borehole is curved, this tensile force on the drill string will apply cutting force normal to the borehole. This force presses the auger against the rock on the inside radius of the curve and would be nearly constant as the pipe is reciprocated in the hole. The auger portion of the pipe would dig in on the inside radius of the hole and cuttings would be transported out of the hole. Conversely if the drill pipe exerts a significant bit weight on the end of the hole then the compressive load in the drill string can exert normal force by a suitably curved hole. For example a constant radius bore hole curving 100 degrees and having a compressive load of 100,000 pounds spread over an arc length of 1000 feet would see a large force against the outside radius of the hole. If the pipe were equipped with augers that turned the opposite of the way described above, the cuttings would be transported to the bottom of the hole, and could be circulated back up the hollow drill pipe. Both of these methods cut a hole at least as large as the auger. The auger may be a smaller diameter than the initial hole, so making a 4" diameter cut from a 7 inch diameter hole should be possible. This would still result in a large volume of cuttings compared to the reciprocating wire rope cable saw of the first implementation of the method.

A very stiff abrasive pipe such as in FIG. 26 or FIG. 28 will apply lateral force to the inside radius of a tightly curving hole. A rotating pipe that is elastically forced through a curved bore will tend to cut a wide slot in the sidewall of the hole. This effect may be used to generate sufficient force to tend to straighten out a curved borehole. The effect of straightening the hole is similar to FIG. 44 where the slot development is greater if the borehole's curves are not all in the same plane.

Instead of a pipe with auger flights, it may be possible to use a large diameter wire rope as an auger. A 2 inch diameter, three-strand steel wire rope cable could be sufficiently stiff to be rotated within a borehole to generate the slot cut. It could also be reciprocated to produce additional cutting action. The wire rope would be significantly lower in cost than the pipe with auger flights. Removal of cuttings is an issue with this concept since there is no pipe to the bottom of the hole. One possible solution is to apply the technique in a hole that enters the ground, descends to target depth and then comes back to the surface. This will allow air or fluid to be circulated through the length of the bore hole to remove cuttings.

Additional Variations on the Method

Another means of applying this method is with a one or more abrasive elements such as commercially available keyseat wiper tools or reamer tools along a section of the drill pipe in a directionally drilled hole that curves down to horizontal and then curves at least partially laterally and at least partially back downward in an S bend as in FIG. 43. The borehole may extend significantly deeper than the bottom of the S bend to so that the weight of the pipe in the lower S bend, due to gravity, continues to provide tensile loading on a the drill pipe operating in the upper parts of the S bend even when the drill string is raised to the top of the rig stroke. The S bend may be in one vertical plane but may also bend into another plane or form a three dimensional curve. The Drill collars would used below the keyseat wiper to increase the tensile loading on the pipe through the S bend. The keyseat wipers are employed in the same way as the Rotary Heavy Pipe Tool previously described to cut into the sidewall of the borehole, with the tension of the pipe providing force to cause them to cut into the inside radius of the borehole curvature. No cable is needed for this method so rig mounted equipment or modifications are not required.

By reciprocating the rotating tool up and down through the S-bend, a slot may be cut into the inside radius of the borehole. A slight lateral turn between the top and bottom of the S-bend will cause the extended slot to cut a curved ribbon-like path even at the inflection point of the S-bend as in FIG. 43. A three dimensional S bend with radius of curvature adjusted based on pipe tension can generate a uniform depth ribbon slot at least all along the curved borehole. Drilling fluid may be reverse circulated, that is pumped down the annulus and back up the drill pipe while cutting the slot. Periodically during the slot cutting process the drill pipe would be lowered to the bottom of the hole to churn up the drill cuttings and reverse circulation of drill mud would be used to bring these cutting back up the drill pipe. The drill pipe itself may be abrasive or it may have abrasive key seat wiper or reamer tools spaced at intervals comparable to the reciprocation length of the rig. For rigs that use three joints of pipe at a time this is nominally 90 feet. The keyseat wiper or reamer tools may be made with helical cutters oriented in left hand or right hand direction. The ones in the portion of hole below the S-bend could be oriented to increase the downward tension on the pipe as they are rotated. Slot cutting may be by reciprocation, rotation or both applied together.

A suitable friction generating device made with an inflatable packer element, or mechanical spring centralizer device 128 may be added near the end of the drill string to create tension as the drill pipe is pulled back. The friction generating device is called a "drag tool". Use of the friction device eliminates the requirement of the lower end of the hole being substantially vertical or the hole being an S-bend. The hole may curve down to horizontal and then curve laterally in any direction including a substantially horizontal plane. As the drill pipe is pulled back toward the surface, the drag tool creates tension in the drill pipe that causes the drill pipe to bear against the sides of the curved hole. Rotation and/or reciprocation of the drill pipe causes it to cut a slot into the wall of the hole along the inside radius of the curved borehole. The entire drill pipe may have abrasive surfaces on its exterior or there may be cutting elements at intervals. The cutting process is based on the principles that cause troublesome keyseats to form while drilling wells. However the method described herein uses these principles in a novel way in conjunction with a controlled profile curved hole to generate slots which at least double the surface area of the wellbore and may increase it by a factor of 100 or more.

The drag tool may be made in a manner similar to an inflatable packer tool such as are described in the inventor's own prior art. U.S. Pat. No. 6,269,878 and U.S. Pat. No. 4,372,562. The exterior of the tool could be formed from rubber or overlapped thin metal strips. The drag tool may be designed to produce drag all the time or only when drilling fluid circulation pressure rises above a certain threshold. A suitable drag device can also be made with bow type centralizer springs pressing against the borehole. The drag tool will preferably create friction with minimal abrasion of the well bore. The hole may optionally have a fiberglass casing installed before slot cutting begins. If the drag tool is designed to produce friction on the down stroke as well as the up stroke then on the upstroke the cutting elements would return to the original borehole and cut the opposite direction, exaggerating the S-bend instead of straightening it out as it does on the up stroke.

Conclusion

This patent application discloses method and apparatus to cut an extended slot connecting a well to a substantial cross section of a desired producing formation whereby material can flow freely between the formation and the wellbore and at least partially overcome the flow limitations of low permeability formations. It is further disclosed that the connection between said slot and the formation may be further enhanced by explosive or combustive processes that rapidly generate gas pressure within the large surface area of the slot, thereby changing its characteristics and forcing open additional fractures into the cross section of formation exposed to the slot. The method may significantly increase the recoverable percentage of natural gas from low permeability deposits such as shale and coal. It is disclosed that there are various means that could be developed to cut a slot from a wellbore to connect the wellbore to a substantial cross section of a desired producing formation and the methods described herein are not intended to limit the scope of the invention.

I claim:

1. A method for increasing well productivity in a desired producing formation, comprising:

drilling a single well bore along a curved pathway through the desired producing formation, the wellbore having a starting point at the earth's surface and a distal end point, wherein a drilling pipe may pass through the entire length of the well bore;

inserting an abrasive cutting member into the well bore, wherein the abrasive cutting member comprises a wire rope comprising abrasive cutting surfaces; and tensioning the cutting member while the cutting member is drawn through the curved pathway;

wherein the cutting member bears against the inside radius of the curved pathway and cuts an extended slot into the desired producing formation; and wherein the single well bore is in a substantially J-shape and extends from the surface, through the curved pathway, and ending as a blind hole at its distal end.

2. The method of claim 1, further comprising:

extending a tubing pipe to substantially the distal end of the well bore, wherein the abrasive cutting member is attached to the distal end of the pipe and to a tensioning means at least above the curved pathway;

reciprocating the abrasive cutting member through the curved pathway to cut the extended slot.

3. The method of claim 1, wherein the well bore extends through a substantially horizontal laterally curved path so as to cut the extended slot in an orientation that is at least partially horizontal.

4. The method of claim 1, wherein the well bore having a curved pathway is formed by drilling a lateral borehole branching from the well bore.

5. The method of claim 1, further comprising:

providing a combustible mixture within the slot; and igniting the combustible mixture to generate a gas pulse sufficient to create fractures at least partially perpendicular to the slot.

6. A method for increasing well productivity in a desired producing formation, comprising:

forming a single well bore having a substantially curved path at least within the producing formation, the wellbore having a starting point at the earth's surface and a distal end point;

attaching an abrasive cable to a drill pipe;

extending the drill pipe from the surface to at least near the curved path, wherein the attached abrasive cable extends at least through a portion of the curved path reciprocating the pipe within the wellbore to produce a sawing action with the abrasive cable and cut an extended slot along the inside radius of the curved path extending away from said wellbore; and tensioning the attached abrasive cable such that the abrasive cable is urged laterally.

7. The method of claim 6, wherein the well bore has at least a portion of the curved path within a substantially non-vertical plane, such that at least a portion of the slot created will be non-vertical.

8. The method of claim 6, wherein the well bore extends from said desired producing formation back to the surface along an inclined path.

9. The method of claim 6, wherein the well bore is a single blind hole borehole.

10. The method of claim 6, further comprising extending the curved path through additional bends so as to produce a slot that may follow a pathway that varies in orientation between horizontal and vertical.

11. The method of claim 6, wherein the curved path is in a substantially U-shape and extends from the surface, through the curved pathway, and back to the surface.

12. The method of claim 11, wherein the curved path is a lateral curved path such that the slot is at least partially horizontal.

13. The method of claim 6, further comprising: extending a tubing pipe from each end of the well bore to a predetermined point approximately where the slot is to be begin; wherein the attached abrasive cable extends at least through the entire said well bore and longitudinally through said tubing pipes; wherein gripping means on each tubing pipe holds the abrasive cable in tension and can release and re-grip the abrasive cable without removing the tubing pipes from the wellbore.

14. The method of claim 13, wherein the gripping means comprises a releasable cable gripping device such that the portion of the abrasive cable between the distal ends of the tubing pipes can be changed by releasing the gripping device and circulating the abrasive cable so that new areas of the abrasive cable are exposed.

15. The method of claim 6, further comprising filling the slot with proppant materials.

16. The method of claim 6, further comprising pumping a lubricating drilling fluid through the wellbore to reduce friction.

17. The method of claim 6, wherein the slot is used to heat the formation.

18. The method of claim 6, wherein the slot is used to extract heat from the formation.

19. The method of claim 6, wherein the method is repeated and adjacent slots are created in the formation, wherein a flow of fluid is established between the adjacent slots to transfer heat between the formation and the slots.

20. The method of claim 6, wherein the slot is used to dispose of wastes by permeation into the formation.

21. A method for increasing well productivity in a desired producing formation, comprising:

drilling a single well bore along a curved pathway through the desired producing formation, wherein the single well bore is in a substantially U-shape and extends from the surface, through the curved pathway, and back to the surface, wherein a drilling pipe may pass through the entire length of the well bore;

extending a tubing pipe from each end of the well bore to the curved pathway;

inserting an abrasive cutting member into the well bore, wherein the abrasive cutting member comprises a wire rope comprising abrasive cutting surfaces, wherein the abrasive cutting member passes through and is attached to each tubing pipe; and pulling on each of the tubing pipes in an alternating manner to draw the abrasive cutting member through the curved pathway to cut the extended slot.

22. The method of claim 21, wherein the well bore extends through a substantially horizontal laterally curved path so as to cut the extended slot in an orientation that is at least partially horizontal.

23. The method of claim 21, wherein the well bore having a curved pathway is formed by drilling a lateral borehole branching from a previous well bore.

24. The method of claim 21, further comprising:

providing a combustible mixture within the slot; and igniting the combustible mixture to generate a gas pulse sufficient to create fractures at least partially perpendicular to the slot.

* * * * *